US008629313B2

(12) United States Patent
Hong et al.

(10) Patent No.: US 8,629,313 B2
(45) Date of Patent: Jan. 14, 2014

(54) HYBRID FLARE APPARATUS AND METHOD

(75) Inventors: Jianhui Hong, Tulsa, OK (US); James Charles Franklin, Broken Arrow, OK (US); Dennis Lee Knott, Broken Arrow, OK (US); Zachary Lewis Kodesh, Tulsa, OK (US); Scott Joseph Fox, Broken Arrow, OK (US)

(73) Assignee: John Zink Company, LLC, Tulsa, OK (US)

( * ) Notice: Subject to any disclaimer, the term of this patent is extended or adjusted under 35 U.S.C. 154(b) by 740 days.

(21) Appl. No.: 12/837,427

(22) Filed: Jul. 15, 2010

(65) Prior Publication Data

US 2012/0015308 A1 Jan. 19, 2012

(51) Int. Cl.

| | |
|---|---|
| ***A62D 3/38*** | (2007.01) |
| ***F23G 7/08*** | (2006.01) |
| ***F23D 14/00*** | (2006.01) |
| ***F23D 14/68*** | (2006.01) |

(52) U.S. Cl.
USPC ..... 588/320; 431/5

(58) Field of Classification Search
USPC ..... 431/5; 588/320
See application file for complete search history.

(56) References Cited

U.S. PATENT DOCUMENTS

| | | | | |
|---|---|---|---|---|
| 2,506,972 | A | | 5/1950 | Schellentrager at al. |
| 3,273,627 | A | | 9/1966 | Zink et al. |
| 3,512,911 | A | | 5/1970 | Reed et al. |
| 3,547,567 | A | | 12/1970 | Turpin |
| 3,703,349 | A | | 11/1972 | Straitz, III |
| 3,749,546 | A | | 7/1973 | Reed et al. |
| 3,771,940 | A | * | 11/1973 | Stranahan et al. ..... 431/4 |
| 3,797,991 | A | | 3/1974 | Straitz, III |
| 3,814,567 | A | | 6/1974 | Zink et al. |
| 3,817,695 | A | | 6/1974 | Reed et al. |
| 3,822,983 | A | | 7/1974 | Proctor et al. |
| 3,893,810 | A | * | 7/1975 | Lientz ..... 422/111 |
| 3,954,385 | A | | 5/1976 | Reed et al. |

(Continued)

FOREIGN PATENT DOCUMENTS

| | | |
|---|---|---|
| EP | 0039376 A1 | 11/1981 |
| EP | 0069486 B1 | 1/1983 |

(Continued)

OTHER PUBLICATIONS

T.W. Lee, M. Fenton and R. Shankland, Effects of Variable Partial Premixing on Turbulent Jet Flame Structure, Combustion and Flame 109, 1997, pp. 536-548, Elsevier Science, Inc.

(Continued)

*Primary Examiner* — John K Fristoe, Jr.
*Assistant Examiner* — Seth W Mackay-Smith
(74) *Attorney, Agent, or Firm* — McAfee & Taft

(57) ABSTRACT

A method of operating a flare assembly is provided. If it is determined that the injection of primary steam into the combustion zone is necessary to achieve smokeless operation, primary steam is injected through a steam injector assembly into the combustion zone. If it is determined that steam is not necessary, an alternative gas is discharged though the steam injector assembly into the combustion zone. In one embodiment, the alternative gas is heated. In another embodiment, if it is determined that steam is necessary, a maximum allowable flow rate of steam is calculated, and the flow rate of steam is modulated to achieve smokeless operation and avoid a flow rate of steam in excess of the maximum allowable flow rate of steam. A flare assembly is also provided.

24 Claims, 9 Drawing Sheets

(56) References Cited

U.S. PATENT DOCUMENTS

| | | | | | |
|---|---|---|---|---|---|
| 3,973,899 | A | | 8/1976 | Reed et al. | |
| 3,982,881 | A | | 9/1976 | Schwartz et al. | |
| 3,994,663 | A | | 11/1976 | Reed | |
| 3,995,986 | A | | 12/1976 | Straitz, III | |
| 4,035,171 | A | | 7/1977 | Reed et al. | |
| 4,036,580 | A | | 7/1977 | Reed et al. | |
| 4,039,276 | A | | 8/1977 | Reed et al. | |
| 4,065,248 | A | | 12/1977 | Straitz, III et al. | |
| 4,084,935 | A | | 4/1978 | Reed et al. | |
| 4,094,632 | A | | 6/1978 | Reed et al. | |
| 4,098,566 | A | | 7/1978 | Zink et al. | |
| 4,105,394 | A | | 8/1978 | Reed et al. | |
| 4,118,173 | A | | 10/1978 | Shakiba | |
| 4,140,471 | A | | 2/1979 | Straitz, III et al. | |
| 4,144,313 | A | * | 3/1979 | Germerdonk et al. | 423/210 |
| 4,154,570 | A | | 5/1979 | Schwartz | |
| 4,154,572 | A | | 5/1979 | Reed et al. | |
| 4,188,183 | A | | 2/1980 | Zink et al. | |
| 4,227,872 | A | * | 10/1980 | Zink et al. | 431/90 |
| 4,229,157 | A | | 10/1980 | Ito et al. | |
| 4,265,611 | A | | 5/1981 | Reed et al. | |
| 4,336,017 | A | | 6/1982 | Desty | |
| 4,419,071 | A | | 12/1983 | Schwartz | |
| 4,457,696 | A | | 7/1984 | Schwartz et al. | |
| 4,486,168 | A | | 12/1984 | Pratley | |
| 4,492,558 | A | | 1/1985 | Schwartz et al. | |
| 4,493,638 | A | | 1/1985 | Scammell | |
| 4,505,668 | A | * | 3/1985 | DiBiano et al. | 431/202 |
| 4,516,932 | A | | 5/1985 | Chaudot | |
| 4,548,577 | A | * | 10/1985 | McGill | 431/202 |
| 4,565,522 | A | | 1/1986 | Schwartz | |
| 4,573,906 | A | | 3/1986 | Schwartz et al. | |
| 4,579,521 | A | | 4/1986 | Schwartz et al. | |
| 4,604,047 | A | | 8/1986 | Coulthard | |
| 4,620,508 | A | * | 11/1986 | Fligner et al. | 122/7 R |
| 4,637,793 | A | | 1/1987 | Schwartz et al. | |
| 4,652,232 | A | | 3/1987 | Schwartz et al. | |
| 4,652,233 | A | | 3/1987 | Hamazaki et al. | |
| 4,824,361 | A | | 4/1989 | McGill et al. | |
| 4,952,137 | A | | 8/1990 | Schwartz et al. | |
| 5,112,216 | A | * | 5/1992 | Tenn | 431/5 |
| 5,135,386 | A | * | 8/1992 | Kelley et al. | 431/11 |
| 5,269,235 | A | * | 12/1993 | McGill et al. | 110/246 |
| 5,275,115 | A | | 1/1994 | Houston | |
| 5,414,207 | A | * | 5/1995 | Ritter | 588/317 |
| 5,649,820 | A | | 7/1997 | Keller et al. | |
| 5,681,160 | A | | 10/1997 | Ellis et al. | |
| 5,810,575 | A | | 9/1998 | Schwartz et al. | |
| 5,846,068 | A | | 12/1998 | Schwartz et al. | |
| 5,865,613 | A | | 2/1999 | Rajewski | |
| 6,012,917 | A | | 1/2000 | Wiseman | |
| 6,146,131 | A | | 11/2000 | Wiseman | |
| 6,485,292 | B1 | | 11/2002 | Rhodes et al. | |
| 6,638,059 | B1 | | 10/2003 | Mougey | |
| 6,702,572 | B2 | | 3/2004 | Hong et al. | |
| 6,837,702 | B1 | * | 1/2005 | Shelor et al. | 431/5 |
| 6,840,760 | B1 | | 1/2005 | Keller et al. | |
| 6,840,761 | B2 | | 1/2005 | Hong et al. | |
| 7,247,016 | B2 | | 7/2007 | Mashhour | |
| 7,354,265 | B2 | | 4/2008 | Mashhour et al. | |
| 7,520,743 | B1 | * | 4/2009 | Roberts | 431/5 |
| 7,677,882 | B2 | | 3/2010 | Harless | |
| 7,677,883 | B2 | | 3/2010 | Harless | |
| 2004/0072110 | A1 | * | 4/2004 | Kayahara et al. | 431/5 |
| 2006/0105276 | A1 | | 5/2006 | Wilkins et al. | |
| 2007/0224564 | A1 | | 9/2007 | Hong et al. | |
| 2007/0292811 | A1 | | 12/2007 | Poe et al. | |
| 2008/0081304 | A1 | | 4/2008 | Poe et al. | |
| 2009/0035709 | A1 | * | 2/2009 | Mennie et al. | 431/5 |

FOREIGN PATENT DOCUMENTS

| | | | |
|---|---|---|---|
| EP | 0126603 | A2 | 11/1984 |
| EP | 0173423 | B1 | 3/1986 |
| EP | 0694736 | A2 | 1/1996 |
| EP | 0872690 | A2 | 10/1998 |
| EP | 1840462 | A2 | 10/2007 |
| FR | 2515313 | | 4/1983 |
| GB | 798979 | | 7/1958 |
| GB | 2007830 | A | 5/1979 |
| GB | 1604441 | | 12/1981 |
| GB | 2081872 | A | 2/1982 |
| GB | 2136557 | A | 9/1984 |
| GB | 2292452 | A | 2/1996 |
| GB | 2304180 | A | 3/1997 |
| WO | WO 02/086386 | A1 | 10/2002 |
| WO | WO 2006/060687 | A2 | 6/2006 |

OTHER PUBLICATIONS

B.M. Cetegen and S. Basu, Soot Topography in a Planar Diffusion Flame Wrapped by a Line Vortex, Combustion and Flame 146, 2006, pp. 687-697, Elsevier Science, Inc.

Book edited by Charles E. Baukal, Jr., Flares, The John Zink Combustion Handbook, 2001, Chapter 20 (by Robert Schwartz, Jeff White and Wes Bussman), pp. 589-634, CRC Press LLC.

Author Unknown, JZ® and Kaldair®—The World's Most Advanced Flares, date unknown, John Zink Company, LLC, http://johnzink.com/products/flares/html/flar_prod.htm.

Author Unknown, Air-Assisted Flares, date unknown, John Zink Company, LLC, http://johnzink.com/products/flares/html/flar_prod_aaf.htm.

John Zink Company, LLC, John Zink Company Azdair PLA-28 Air Assisted Flare System, 2008, p. 1 of 1.

The United States District Court for the Southern District of Ohio, Revised Consent Decree, Feb. 3, 2010 (published by/in The United States District Court for the Southern District of Ohio).

Patent Examination Report No. 1 dated Aug. 31, 2012 in corresponding Australian application No. 2011203216, John Zink Company, LLC.

Office Action dated Dec. 12, 2012 in corresponding Canadian application No. 2,744,133, John Zink Company, LLC.

Examination Report dated May 23, 2013 with Search Report in corresponding Singapore application No. 201104852-7, John Zink Company, LLC.

* cited by examiner

HYBRID FLARE APPARATUS AND METHOD

BACKGROUND OF THE INVENTION

Waste gas flare assemblies are commonly located at production facilities, refineries, processing plants and the like (collectively "facilities") for disposing of flammable gas streams that are released due to venting requirements, shutdowns, upsets and/or emergencies. Such flare assemblies are typically required to accommodate waste gases that vary in composition over a wide range and operate over a very large turndown ratio (from maximum emergency flow to a purge flow rate) and extended periods of time without maintenance.

A typical single-point flare assembly includes a flare riser, which can extend a few feet to several hundred feet above the ground, and a flare tip mounted to (e.g., in a vertical flare, on the top of) the flare riser. The flare tip typically includes one or more pilots for igniting the vent gas. Depending on the particular flare tip design and available gas pressure, some flares include smoke suppression equipment such as steam injectors or air blowers.

Waste gas can be released at any time during operation of a facility. As a result, an integrated ignition system that can immediately initiate burning throughout the period of waste gas flow is critical. An integrated ignition system includes at least one pilot, at least one pilot ignition mechanism and at least one pilot flame monitor. Pilot gas must generally be supplied to the flare pilot at all times.

Due to various process and/or regulatory considerations, various other gases are sometimes added to the released waste gas stream. Examples of other gases that are sometimes added to the released waste gas stream include purge gas (for example, natural gas or nitrogen) and enrichment fuel gas (for example, natural gas or propane). The gas stream that arrives at the inlet of the flare tip is referred to as "vent gas," regardless of whether it consists of only the released waste gas or the released waste gas together with other gases that have been added thereto. The vent gas together with all other gases and vapors present in the atmosphere immediately downstream of the flare tip, not including air but including steam added at the flare tip and fuel gas discharged from the pilot(s) of the flare assembly, is referred to as "flare gas."

Purge gas is often added to the released waste gas stream (or otherwise to the flare assembly if a waste gas stream is not being released by the facility at the time) in order to maintain a positive gas flow through the flare assembly and prevent air and possibly other gases from back flowing therein. Enrichment fuel gas is sometimes added to the waste gas stream to help assure that the required minimum net heating value of the vent gas is met. Current regulations in the United States relating to flares (such as the regulations at 40 C.F.R. §60.18) specify that the net heating value of the vent gas is to be no less than 300 British thermal units (Btu's) per standard cubic foot (scf). Certain consent decrees between flare owners and the U.S. Environmental Protection Agency (the "EPA") may specify that the net heating value of the vent gas must be even higher than 300 Btu/scf. Whether an enrichment fuel is used, as well as the amount of enrichment fuel used, will depend on the composition of the waste gas stream, the flow rate of the waste gas stream and applicable regulations relating to operation of the flare.

Most gas flares are required to operate in a relatively smokeless manner. This is achieved by making sure that the vent gas is admixed with a sufficient amount of air in a relatively short period of time to sufficiently oxidize the soot particles formed in the flame. In applications where the gas pressure is low, the momentum of the vent gas stream alone may not be sufficient to provide smokeless operation. In such applications, it is necessary to add an assist medium to achieve smokeless operation. The assist medium can be used to provide the necessary motive force to entrain ambient air from around the flare apparatus. Examples of useful assist media include steam and air. Many factors, including local energy costs and availability, must be taken into account in selecting a smoke suppressing medium.

The most common assist medium for adding momentum to low-pressure gases is steam, which is typically injected through one or more groups of nozzles that are associated with the flare tip. In addition to adding momentum and entraining air, steam also dilutes the gas and participates in the chemical reactions involved in the combustion process, both of which assist with smoke suppression. In one simple steam assist system, several steam injectors extend from a steam manifold or ring that is mounted near the exit of the flare tip. The steam injectors direct jets of steam into the combustion zone adjacent the flare tip. One or more valves (which can be remotely controlled or automatically controlled) adjust steam flow to the flare tip. The steam jets inspirate air from the surrounding atmosphere and inject it into the discharged vent gas with high levels of turbulence. These jets may also act to gather, contain, and guide the gases exiting the flare tip. This prevents wind from causing flame pull down around the flare tip. Injected steam, educted air, and the vent gas combine to form a mixture that helps the vent gas burn without visible smoke. Other steam assist systems have been developed and successfully utilized in connection with more complex flare systems.

Most steam-assisted flares require a minimum steam flow in order to keep the steam line from the control valve to the flare tip warm and ready for use and to minimize problems with condensate in the steam line. Also, a minimum steam flow keeps the manifold and other steam injection parts on or near the flare tip cool which helps prevent heat damage thereto (for example, in the event a low flow flame attaches to the steam equipment).

Operation of a flare assembly in freezing conditions creates additional issues that must be addressed. For example, when steam is discharged through the flare assembly at a low flow rate to cool the steam equipment when the flare is in a standby condition or to assist a low volume flaring event, freezing temperatures may cause the steam to condense and form ice on or around the flare tip. Also, condensation can occur in the steam line running from the source of steam to the flare assembly. In some cases, the steam line is very long and, despite the use of insulation, prone to condensation. The condensation can be sprayed at the flare tip and ultimately freeze in or around the flare tip and associated equipment. The formation of ice on or around the vent gas discharge opening, for example, can lead to blockage of the discharge opening and other serious problems.

As the flow rate and/or composition of vent gas sent to a flare tip varies, the amount of steam required for smoke suppression changes. Many plants adjust the steam requirement based on periodic observations by an operator in the control room looking at a video image from a camera monitoring the flare. Smoking conditions may be corrected by increasing the rate of steam flow to the flare. However, when the vent gas flow begins to subside, the flare flame may continue to look "clean" to the operator, which may allow some time to pass before the operator reduces the steam flow. As a result, this method of smoke control tends to result in over-steaming of the flare which in turn may lead to excessive noise and unnecessary steam consumption, low destruction and removal efficiency, or even extinguish the main flame altogether.

Too much steam can cause the ratio of the flow rate of steam discharged by the flare assembly to the flow rate of vent gas discharged by the flare assembly (the "steam/vent gas ratio") to become too high, which can in turn reduce the net heating value of the flare gas in the combustion zone to a point that combustion cannot be sustained. This can particularly be a problem when the vent gas flow rate is at a low level. It can also be a problem when the flare assembly is in standby condition, and there is only minimum flow of purge gas through the stack. Allowing the steam/vent gas ratio to exceed a certain level and the net heating value of the flare gas to become too low may violate one or more regulations relating to operation of the flare assembly.

A wide variety of factors impact the destructive removal efficiency (DRE) of a flare, including ambient conditions, vent gas flow rate and composition, vent gas exit velocity, steam flow rate, steam exit velocity, the amount of air entrained by the steam, how well and how rapidly the steam and entrained air mix with the vent gas, and the design of the flare tip. As a result, it is difficult to specify simple operating parameters that ensure a high DRE and prevent over-steaming.

Flare vendors typically require a minimum standby steam flow rate for purposes such as keeping the steam line warm and preventing the steam injector assembly and related equipment from heat damage. The flow rate of the steam cannot be reduced below the minimum standby rate recommended by the flare vendor without risking problems such as the problems described above. Furthermore, a lower rate of steam may not be sufficient to achieve smokeless operation, which may also violate applicable regulations regarding visible emissions and is undesirable in most applications. Due to the low exit velocity and resulting low air entrainment rate of steam at turndown steam rates, it takes a higher steam/vent gas ratio to achieve smokeless operation of a flare than that required when steam is injected at sonic velocity. Under some circumstances, both smoking and over-steaming, as legally defined by applicable regulations, cannot be avoided at the same time in a conventional steam assisted flare, no matter how the steam flow rate is adjusted. Increasing the purge gas flow rate (as opposed to reducing the steam flow rate) may help with compliance but the costs of the increased purge gas may be prohibitive. The increased purge gas may also contribute to higher emissions of carbon dioxide, a gas related to greenhouse effects. This can create a dilemma for owners of steam-assisted flares with respect to operation of the flare.

A primary purpose of a flare assembly is to destroy and control potentially harmful compounds such as sulfur compounds, carbon monoxide and unburned hydrocarbons. As a result, the operation of a flare assembly is regulated and monitored by various governmental agencies. The particular regulations that apply depend on the particular location of the flare assembly. In the United States, for example, the operation of a flare assembly is regulated and monitored by the EPA. Flare regulations in the United States include regulations in the Code of Federal Regulations (CFR) and settlement agreements (for example, consent decrees) reached between regulating agencies such as the EPA and facilities. State and local regulations may also apply.

It is anticipated that more stringent regulations with respect to operation of a flare assembly may be implemented by the EPA in the near future. These new regulations may be in the form of consent decrees reached between the EPA and flare owners, or may be made a part of the applicable Code of Federal Regulations. The new regulations will likely address, for example, the maximum steam/vent gas ratio (or steam/hydrocarbon ratio) that can be employed, the minimum net heating value of the vent gas, and the minimum net heating value of the flare gas in the combustion zone. In view of these regulations, it may become even more difficult for a conventional steam-assisted flare assembly to achieve smokeless operation, prevent over-steaming and address other problems such those described above. Simply reducing the amount of steam may not be a sufficient solution.

SUMMARY OF THE INVENTION

In accordance with the present invention, a method of operating a flare assembly that receives a waste gas stream at a varying flow rate, conducts a vent gas stream to a flare tip, discharges the vent gas stream through the flare tip into a combustion zone in the atmosphere, discharges primary steam through a steam injector assembly into the combustion zone and burns flare gas in the combustion zone is provided.

In one embodiment, the inventive method comprises the following steps:

a. providing a source of alternative gas;
b. providing a source of primary steam;
c. receiving the waste gas stream;
d. determining the flow rate of the vent gas stream;
e. discharging the vent gas stream through the flare tip into the combustion zone;
f. igniting and combusting flare gas in the combustion zone;
g. determining if the injection of primary steam into the combustion zone is necessary to achieve smokeless operation;
h. if it is determined in step (g) that the injection of primary steam into the combustion zone is necessary to achieve smokeless operation, carrying out the following steps:
   i. shutting off the flow of alternative gas through the steam injector assembly into the combustion zone if alternative gas is being discharged through the steam injector assembly into the combustion zone;
   ii. discharging primary steam through the steam injector assembly into the combustion zone;
   iii. determining the flow rate of primary steam discharged through the steam injector assembly into the combustion zone; and
   iv. modulating the flow rate of primary steam through the steam injector assembly into the combustion zone to achieve smokeless operation; and
i. if it is determined in step (g) that the injection of primary steam into the combustion zone is not necessary to achieve smokeless operation, carrying out the following steps:
   i. shutting off the flow of primary steam through the steam injector assembly into the combustion zone if primary steam is being discharged through the steam injector assembly into the combustion zone;
   ii. discharging alternative gas through the steam injector assembly into the combustion zone; and
   iii. heating the alternative gas prior to discharging the alternative gas through the steam injector assembly into the combustion zone.

In another embodiment, the inventive method comprises the following steps:

a. providing a source of alternative gas;
b. providing a source of primary steam;
c. receiving the waste gas stream;
d. determining the flow rate of the vent gas stream;
e. discharging the vent gas stream through the flare tip into the combustion zone;

f. igniting and combusting flare gas in the combustion zone;

g. determining if the injection of primary steam into the combustion zone is necessary to achieve smokeless operation;

h. if it is determined in step (g) that the injection of primary steam into the combustion zone is necessary to achieve smokeless operation, carrying out the following steps:
   i. shutting off the flow of alternative gas through the steam injector assembly into the combustion zone if alternative gas is being discharged through the steam injector assembly into the combustion zone;
   ii. discharging primary steam through the steam injector assembly into the combustion zone;
   iii. determining the flow rate of primary steam discharged through the steam injector assembly into the combustion zone;
   iv. calculating a maximum allowable flow rate of primary steam through the steam injector assembly into the combustion zone; and
   v. modulating the flow rate of primary steam through the steam injector assembly into the combustion zone to achieve smokeless operation and avoid a flow rate of steam in excess of the maximum allowable flow rate of steam; and i. if it is determined in step (g) that the injection of primary steam into the combustion zone is not necessary to achieve smokeless operation, carrying out the following steps:
   i. shutting off the flow of primary steam through the steam injector assembly into the combustion zone if primary steam is being discharged through the steam injector assembly into the combustion zone; and
   ii. discharging alternative gas through the steam injector assembly into the combustion zone.

The various steps of the first and second embodiments of the inventive method can be interchanged if desired. For example, the steps of calculating a maximum allowable flow rate of primary steam through the steam injector assembly into the combustion zone and modulating the flow rate of primary steam through the steam injector assembly into the combustion zone to achieve smokeless operation and avoid a flow rate of steam in excess of the maximum allowable flow rate of steam can be used in association with the first embodiment of the inventive method as described above if it is determined in step (g) that the injection of primary steam into the combustion zone is not necessary to achieve smokeless operation.

The present invention also provides a flare assembly that receives a waste gas stream at a varying flow rate. The flare assembly can be used to carry out the inventive method.

In one embodiment, the inventive flare assembly comprises a flare riser for conducting a vent gas stream, a flare tip attached to the flare riser for discharging the vent gas stream into a combustion zone in the atmosphere and burning flare gas in the combustion zone, a steam injector assembly associated with the flare tip, a steam transfer conduit, an alternative gas transfer conduit, a control unit connected to the flare assembly, and a heating assembly.

The steam injector assembly includes a steam riser and a steam injection nozzle. The steam riser has a lower section and an upper section. The lower section of the steam riser includes a first fluid inlet and a second fluid inlet. The steam injection nozzle is fluidly connected to the upper section of the steam riser for injecting primary steam into the combustion zone.

The steam transfer conduit is fluidly connected at one end to a source of primary steam and the other end to the first inlet of the steam riser. The steam transfer conduit is fluidly connected to a steam control valve for controlling the flow of primary steam through the steam riser.

The alternative gas transfer conduit is fluidly connected at one end to a source of alternative gas and the other end to the second inlet of the steam riser. The alternative gas transfer conduit is fluidly connected to an alternative gas control valve for controlling the flow of alternative gas through the steam riser.

The control unit controls the steam control valve and the alternative gas control valve. The heating assembly is associated with one of the alternative gas conduit and the steam riser for heating alternative gas that passes through the steam riser conduit.

In another embodiment, the inventive flare assembly comprises a flare riser for conducting a vent gas stream, a flare tip attached to the flare riser for discharging the vent gas stream into a combustion zone in the atmosphere and burning flare gas in the combustion zone, a steam injector assembly associated with the flare tip, a steam transfer conduit, an alternative gas transfer conduit, a flow sensor associated with the flare riser for sensing the flow rate of the vent gas stream, and a control unit connected to the flare assembly.

The steam injector assembly includes a steam riser and a steam injector nozzle. The steam riser has a lower section and an upper section. The lower section of the steam riser includes a first fluid inlet and a second fluid inlet. The steam injection nozzle is fluidly connected to the upper section of the steam riser for injecting primary steam into the combustion zone.

The steam transfer conduit is fluidly connected at one end to a source of primary steam and the other end to the first inlet of the steam riser. The steam transfer conduit is fluidly connected to a steam control valve for controlling the flow of primary steam through the steam riser.

The alternative gas transfer conduit is fluidly connected at one end to a source of alternative gas and the other end to the second inlet of the steam riser. The alternative gas transfer conduit is fluidly connected to an alternative gas control valve for controlling the flow of alternative gas through the steam riser.

The control unit of the second embodiment of the inventive flare assembly is for controlling the steam control valve and the alternative gas control valve. The control unit is responsive to the flow rate of the vent gas stream and capable of calculating a maximum allowable flow rate of primary steam through the steam injector assembly into the combustion zone and modulating the flow rate of primary steam through the steam injector assembly into the combustion zone to avoid a flow rate of steam in excess of the maximum allowable flow rate of steam.

The various components of the first and second embodiments of the inventive flare assembly can be interchanged if desired. For example, the vent gas stream flow sensor and control unit of the second embodiment of the inventive flare assembly can be used in connection with the first embodiment of the inventive flare assembly.

The objects, features and advantages of the present invention will be readily apparent to those skilled in the art upon a reading of the following detailed description.

BRIEF DESCRIPTION OF THE DRAWINGS

FIG. 9 illustrates the use of a steam eductor as the alternative gas mover of the inventive flare assembly with an associated condensing unit and heater.

DETAILED DESCRIPTION

Figure 1:
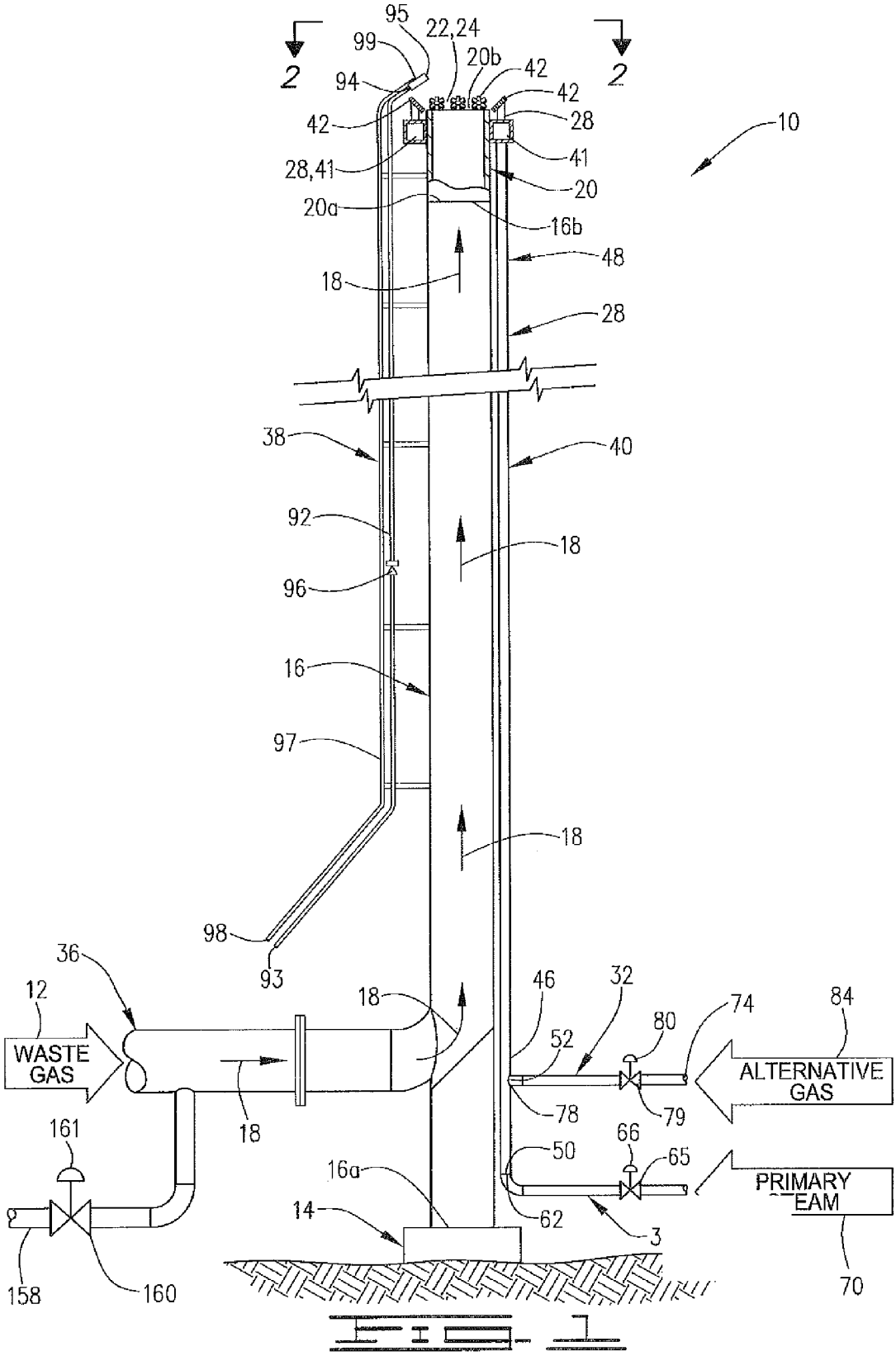
FIG. 1 illustrates one configuration of the inventive flare apparatus.

As used herein and in the appended claims, the terms set forth below shall have the following meanings:

A "facility" means a production facility, refinery, chemical plant, processing plant or any other facility from which waste gas is released due to venting requirements, shutdowns, upsets, emergencies or other reasons.

"Waste gas" means the organic material, nitrogen, and any other gases that are released from the facility for disposal and received by the flare assembly.

"Vent gas" means the waste gas as defined above together with other gases and vapors, if any, added to the waste gas stream before the waste gas stream enters the flare tip of the flare assembly.

"Flare gas" means the vent gas as defined above plus all other gases and vapors present in the atmosphere immediately downstream of the flare tip, not including air but including steam added at the flare tip and fuel gas discharged from the pilot(s) of the flare assembly.

"Primary steam" means steam that is directly discharged through the steam injector assembly located at the flare tip and used to achieve smokeless operation.

"Supplemental steam" means steam used as a motive fluid to educt air into the steam injector assembly.

"Smokeless Operation" means operation of the flare assembly within the limitations on visible smoke emissions set by applicable regulations, the flare owner and/or the flare operator. For example, in the United States, visible smoke emissions from flares are regulated by 40 C.F.R. §60.18. In some countries, visible smoke emissions are not regulated; however, limitations on visible smoke emissions are set by the flare owner or operator based on desires of the local community. Thus, for example, determining if the injection of primary steam into the combustion zone is necessary to achieve smokeless operation in accordance with step (g) of the inventive method means determining if the injection of primary steam into the combustion zone is necessary to operate the flare assembly within the limitations on visible smoke emissions that have been set by applicable regulations, the flare owner and/or the flare operator.

"Applicable regulations" means requirements placed upon the flare owner or operator (the "flare operator") by regulatory authorities, including requirements in consent decrees between the flare operator and regulatory authorities.

The "steam/vent gas ratio" means the ratio of the flow rate of steam discharged through the steam injector assembly to the flow rate of vent gas.

The "hydrocarbon flow rate" means the flow rate of the vent gas stream multiplied by the percentage of hydrocarbon(s) in the vent gas stream. Thus, for example, if the vent gas stream flow rate is 1000 pounds per hour and the vent gas stream consists of 80% nitrogen and 20% propane on a mass basis, the hydrocarbon flow rate is 200 pounds per hour.

The "steam/hydrocarbon ratio" means the ratio of the flow rate of steam discharged through the steam injector assembly to the hydrocarbon flow rate.

"Net heating value" means lower heating value.

Unless specified otherwise, "determined based on a factor or parameter" means determined either in part or in whole based on the factor or parameter.

Similarly, unless specified otherwise, "calculated based on a factor or parameter" means calculated either in part or in whole based on the factor or parameter.

A flow rate sensor means any device that can be used to determine the applicable fluid flow rate, including but not limited to orifice flow meters, ultrasonic flow meters, venturi flow meters, vortex flow meters, anemometers and Pitot tubes.

The flow rates referenced herein can be measured on a mass or volume basis, unless otherwise specified.

In one aspect, the invention is a method of operating a flare assembly that receives a waste gas stream at a varying flow rate, conducts a vent gas stream to a flare tip, discharges the vent gas stream through the flare tip into a combustion zone in the atmosphere, discharges primary steam through a steam injector assembly into the combustion zone and burns flare gas in the combustion zone. In another aspect, the invention is a flare assembly that receives a waste gas stream. The inventive flare assembly is an example of a flare assembly that can be operated in accordance with the inventive method.

The Inventive Method

The inventive method comprises the following steps:

a. providing a source of alternative gas;
b. providing a source of primary steam;
c. receiving the waste gas stream;
d. determining the flow rate of the vent gas stream;
e. discharging the vent gas stream through the flare tip into the combustion zone;
f. igniting and combusting flare gas in the combustion zone;
g. determining if the injection of primary steam into the combustion zone is necessary to achieve smokeless operation;
h. if it is determined in step (g) that the injection of primary steam into the combustion zone is necessary to achieve smokeless operation, carrying out the following steps:
   i. shutting off the flow of alternative gas through the steam injector assembly into the combustion zone if alternative gas is being discharged through the steam injector assembly into the combustion zone;

ii. discharging primary steam through the steam injector assembly into the combustion zone;

iii. determining the flow rate of primary steam discharged through the steam injector assembly into the combustion zone; and iv. modulating the flow rate of primary steam through the steam injector assembly into the combustion zone to achieve smokeless operation; and i. if it is determined in step (g) that the injection of primary steam into the combustion zone is not necessary to achieve smokeless operation, carrying out the following steps:

i. shutting off the flow of primary steam through the steam injector assembly into the combustion zone if primary steam is being discharged through the steam injector assembly into the combustion zone; and ii. discharging alternative gas through the steam injector assembly into the combustion zone.

The alternative gas is air. The air may be mixed with supplemental steam and/or any other gas(es) used as a motive fluid to educt air into the steam injector assembly if an eductor is used in association with the inventive method.

The source of the air (and hence a source of alternative gas provided in step (a) of the inventive method) can be the surrounding atmosphere. For example, the air can be drawn from the atmosphere surrounding the flare assembly and moved into the steam injector assembly by an alternative gas mover. The alternative gas mover can be, for example, an air fan, an air blower, an air compressor or an eductor.

If an eductor is used as an alternative gas mover to draw air from the atmosphere surrounding the flare assembly and move the air into the steam injector assembly, steam can be used as the motive fluid. This steam, defined herein as supplemental steam, can be obtained from the same source that provides the primary steam. When supplemental steam is used, some of the supplemental steam can be mixed with the air being educted into the steam injector assembly and thereby becomes part of the alternative gas. If desired, the supplemental steam can be removed from the alternative gas as described further below.

The source of primary steam provided in accordance with step (b) of the inventive method can be, for example, a boiler. The pressure generated by the boiler forces the primary steam into the steam injector assembly.

The waste gas is received by the flare assembly. For example, the waste gas is conducted from the facility to a waste gas conduit and into the flare riser of the flare assembly.

The flow rate of the vent gas stream in accordance with step (d) of the inventive method can be determined by, for example, a flow rate sensor that is disposed in the waste gas transfer conduit or flare riser (as described below) at a point therein downstream of points in the waste gas transfer conduit or flare riser where other gases and vapors, if any, have been added to the waste gas stream but upstream of the flare tip (i.e., at a point in the flare assembly before the vent gas stream enters the flare tip). Alternatively, the flow sensor can be located at a point to measure the flow rate of waste gas before any gas (such as enrichment gas) is added to the waste gas. The flow rate of the vent gas stream can then be determined by adding the known flow rate of enrichment gas (if any) to the measured flow rate of waste gas.

Determining if the injection of primary steam into the combustion zone is necessary to achieve smokeless operation in accordance with step (g) can be carried out either manually or automatically. For example, if alternative gas is being injected into the combustion zone at the time, the flare operator can monitor the flame generated by the flare assembly (either directly by sight or indirectly using a video camera capturing the flame) to see if visible smoke is present therein. If the flare operator detects visible smoke (even after the alternative gas reaches its maximum flow rate, for example), or otherwise determines that it is necessary to inject primary steam into the combustion zone to achieve smokeless operation, he or she can implement step (h) of the inventive method (including the sub-steps thereof). If the flare operator determines that there is no visible smoke, that any visible smoke from the flare flame can be eliminated by increasing the alternative gas flow rate, or otherwise determines that the injection of primary steam into the combustion zone is not necessary to achieve smokeless operation, he or she can continue to inject alternative gas into the combustion zone in accordance with step (i) of the inventive method (including the sub-steps thereof).

By way of further example, if primary steam is being injected into the combustion zone at the time, the flare operator can monitor the flame generated by the flare assembly (either directly or indirectly using a video camera capturing the flame) to see if visible smoke is present therein. If the flare operator determines that there is no visible smoke (even after reducing the primary steam flow rate to the minimum flow rate, for example), or otherwise determines that the injection of primary steam into the combustion zone is not necessary to achieve smokeless operation, he or she can implement step (i) of the inventive method (including the sub-steps thereof). If the flare operator determines that the injection of primary steam into the combustion zone is necessary to achieve smokeless operation, he or she can continue to inject primary steam into the combustion zone in accordance with step (h) of the inventive method (including the sub-steps thereof).

The flare operator may be able to determine that the injection of primary steam into the combustion zone is not necessary to achieve smokeless operation merely by observing the quality of the waste gas being released by the facility. Waste gases such as natural gas, hydrogen sulfide, hydrogen and carbon monoxide do not tend to generate visible smoke.

There are several ways in which the determination of whether the injection of primary steam into the combustion zone is necessary to achieve smokeless operation in accordance with step (g) can be automatically carried out. For example, a computer can make the determination in accordance with step (g) based on one or more parameters such as the vent gas stream flow rate, the net heating value of the vent gas stream, the molecular weight of the vent gas stream, the percentage of inert gas in the vent gas stream, and the estimated flow rate of primary steam required to achieve smokeless operation for the given vent gas stream. Such parameters can also be used to estimate whether visible smoke is present for the given vent gas stream at the maximum rate of alternative gas and, if so, the extent thereof. These parameters or combination of parameters are often developed and provided by flare vendors, but in some cases flare owners and operators may develop and implement their own criteria or algorithms.

If it is determined in accordance with step (g) that the injection of primary steam into the combustion zone is necessary to achieve smokeless operation, step (h) of the inventive method is implemented. It may be that alternative gas is being discharged through the steam injector assembly into the combustion zone at the time such a determination is made. If so, the flow of alternative gas through the steam injector assembly into the combustion zone is first shut off in accordance with step (h) (i). The pressure at which the primary steam is discharged into the steam injector assembly can be substantially higher than the pressure at which the alternative gas is discharged into the steam injector assembly. As a result, if the valve allowing alternative gas flow is open when the flow of primary steam into the flare assembly is initiated, the steam may backflow into the alternative gas mover (which is itself a waste of steam) and can potentially cause damage to the alternative gas mover and other equipment.

Primary steam is then discharged through the steam injector assembly into the combustion zone in accordance with step (h) (ii), and the flow rate of the primary steam discharged through the steam injector assembly into the combustion zone is determined in accordance with step (h) (iii). The flow rate of the primary steam discharged through the steam injector assembly can be determined by, for example, a primary steam flow rate sensor that is disposed in the steam transfer conduit, preferably at or near ground level to allow easy access thereto.

The step of modulating the flow rate of primary steam to achieve smokeless operation in accordance with step (h) (iv) can also be carried out manually by the flare operator or automatically (e.g., by the computer). For example, the operator can incrementally increase the flow rate of primary steam through the steam injector assembly into the combustion zone until smokeless operation is achieved. Due to the cost of steam and in order to prevent over-steaming, the operator should try to avoid the use of a flow rate of primary steam that is significantly higher than the flow rate required to achieve smokeless operation.

If it is determined in accordance with step (g) that the injection of primary steam into the combustion zone is not necessary to achieve smokeless operation, and primary steam is being discharged through the steam injector assembly into the combustion zone at the time, the flow of primary steam is first shut off. As stated above, implementing the flow of primary steam while the valve allowing alternative gas flow is open can cause damage to the air mover and other equipment. Furthermore, due to the differential between the pressure at which the steam is discharged and the pressure at which the air is discharged, it would not be possible to move the air into the flare assembly when the primary steam valve is open. Once the flow of primary steam is off, alternative gas is discharged through the steam injector assembly into the combustion zone.

Due to over-steaming concerns, it is typically desirable to operate the flare assembly in the alternative gas flow mode whenever possible. In many applications, primary steam is not necessary to prevent smokeless operation. In these applications, the alternative gas serves as an effective assisting medium for preventing smokeless operation. A minimum flow of alternative gas keeps the manifold and other steam injection parts on or near the flare tip cool which helps prevent heat damage thereto (for example, in the event a low flow flame attaches to the steam equipment). The use of the alternative gas instead of the primary steam helps assure that the required or desired flare gas net heating value, steam/vent gas ratio and steam/hydrocarbon ratio are maintained, particularly when the vent gas flow rate is low.

Depending on the application, the inventive method can also include one or more additional steps.

First, prior to discharging the alternative gas through the steam injector assembly into the combustion zone in accordance with step (i) (ii), the alternative gas can be heated. This step is particularly useful when the inventive method is used to operate a flare assembly in freezing conditions. For example, when the flare assembly is in a standby condition or is being operated in response to a low volume flaring event, steam being discharged through the steam injector assembly may condense and form ice on or around the flare tip. In this situation, it may be determined in accordance with step (g) of the inventive method that it is not necessary to inject steam into the combustion zone to achieve smokeless operation, and step (i) (including the sub-steps thereof) of the inventive method is carried out. By discharging alternative gas through the steam injector assembly into the combustion zone in lieu of primary steam, the problems associated with the freezing conditions can be avoided.

Preheating the alternative gas can prevent or lessen what is known as a "water hammer" condition, a condition in which condensation from steam in the cold steam riser being pushed through the steam injector assembly quickly is suddenly decelerated due to a bend or obstruction. A water hammer condition can damage the steam riser, steam injector assembly, and associated equipment. Preheating the alternative gas also avoids problematic condensation of moisture in the alternative gas which can cause corrosion of the steam riser. A minimum flow of pre-heated alternative gas keeps the steam line from the control valve to the flare tip warm and ready for use, which minimizes condensation in the steam line.

The alternative gas can be heated in a variety of ways. For example, the alternative gas can be heated by a steam-powered heat exchanger, an electric heater or a gas fired heating assembly. If a steam-powered heat exchanger is used, the steam can come from the source as the primary steam used in the inventive method.

The inventive method can also include additional steps that can provide more sophisticated control with respect to operation of the flare assembly. These steps can be used, for example, to help assure that the steam is operated in an efficient manner and to help assure that applicable regulations are met.

If it is determined in step (g) of the inventive method that the injection of steam into the combustion zone is necessary to achieve smokeless operation, a maximum allowable flow rate of primary steam through the steam injector assembly into the combustion zone can be calculated. The flow rate of primary steam through the steam injector assembly into the combustion zone is then modulated in accordance with step (h) (iv) to achieve smokeless operation and avoid a flow rate of steam in excess of the maximum allowable flow rate of steam.

The maximum allowable flow rate of primary steam through the steam injector assembly into the combustion zone can be calculated based on various criteria, including applicable regulations with respect to operation of the flare assembly in the location in which the flare assembly is installed and algorithms established by the flare vendor, flare owner and/or flare operator. Algorithms established by flare vendors, owners and operators are typically more stringent than those necessary to assure that the flare assembly merely complies with applicable regulations. For example, while applicable regulations may establish a boundary or limits for flare operation, the most economic and efficient operation of a steam-assisted flare may use less steam than the maximum allowed by regulations, as long as the rate of steam is sufficient to achieve smokeless operation.

Depending on the specific algorithm(s) employed, the maximum allowable flow rate of primary steam through the steam injector assembly into the combustion zone can be calculated based on a variety of parameters, including one or more of the following, each of which is determined in accordance with the inventive method:

1. The vent gas stream flow rate.
2. The maximum steam/vent gas ratio that is to be allowed. The maximum allowable steam/vent gas ratio can be determined based on applicable regulations with respect to operation of the flare assembly in the location in which the flare assembly is installed.

3. The maximum steam/hydrocarbon ratio that is to be allowed. In order to determine the maximum steam/hydrocarbon ratio, the hydrocarbon flow rate must first be determined. The maximum allowable steam/hydrocarbon ratio can be determined based on applicable regulations with respect to operation of the flare assembly in the location in which the flare assembly is installed.
4. The minimum allowable net heating value of the flare gas. The minimum allowable net heating value of the flare gas can be determined based on applicable regulations with respect to operation of the flare assembly in the location in which the flare assembly is installed.
5. The molecular weight of the vent gas stream. The molecular weight of the vent gas stream can be determined by, for example, a molecular weight sensor that is disposed in the waste gas transfer conduit or flare riser (as described below) at a point therein downstream of points in the waste gas transfer conduit or flare riser where other gases and vapors, if any, have been added to the waste gas stream but upstream of the flare tip (i.e., at a point in the flare assembly before the vent gas stream enters the flare tip).
6. The net heating value of the vent gas stream. The net heating value of the vent gas stream can be determined by, for example, a net heating value sensor that is disposed in the waste gas transfer conduit or flare riser (as described below) at a point therein downstream of points in the waste gas transfer conduit or flare riser where other gases and vapors, if any, have been added to the waste gas stream but upstream of the flare tip (i.e., at a point in the flare assembly before the vent gas stream enters the flare tip).
7. The composition of the vent gas stream. For example, the speciation data from a gas chromatographic device (a "GC Device") can be used to estimate the amount of steam required to achieve smokeless operation and the maximum allowable steam rate in an attempt to achieve high destructive removal efficiency (DRE).
8. Other real time properties of the vent gas stream including but not limited to the associated thermal conductivity and Wobbe Index.

In addition to adding momentum and entraining air, the primary steam also dilutes the vent gas and participates in the chemical reactions involved in the combustion process, both of which assist with smoke suppression. As the flow rate and/or composition of vent gas sent to the flare tip varies, the amount of steam required for smoke suppression changes. The added degree of control provided by the inventive method facilitates imparting the right amount of steam to the combustion zone at the right time. Operational parameters such as the steam/vent gas ratio, steam/hydrocarbon ratio, vent gas net heating value and flare gas net heating value can be accurately controlled.

The inventive method can also include the step of adding enrichment fuel gas to help assure that the required minimum net heating value of the vent gas and other required and desired operational parameters are met. For example, the actual net heating value and the minimum allowable net heating value of the vent gas stream are each determined. The minimum allowable net heating value of the vent gas stream can be determined based on applicable regulations with respect to operation of the flare assembly in the location in which the flare assembly is installed. If the actual net heating value of the vent gas stream is less than the minimum allowable net heating value of the vent gas stream, enrichment fuel gas is added to the vent gas stream in an amount sufficient to increase the actual net heating value of the vent gas stream to a level that is at least as high as the minimum allowable net heating value of the vent gas stream. Examples of enrichment fuel gases that can be used include natural gas and propane.

Purge gas can also be added to the waste gas stream (or otherwise to the flare assembly if a waste gas stream is not being released by the facility at the time) in order to maintain a positive gas flow through the flare assembly and prevent air and possibly other gases from back flowing therein. Examples of purge gases that can be used include nitrogen, natural gas and propane. Depending on the location of the flare, applicable regulations may require that the purge gas be a combustible gas.

As they are considered part of the vent gas, any enrichment fuel gas, purge gas or other gases and vapors added to the waste gas stream are added before the flow rate of the vent gas stream is sensed and before the molecular weight and net heating value of the vent gas stream are determined Alternatively, the flow rate and other properties of the vent gas stream can be determined indirectly before enrichment fuel gas, purge gas and/or other gases and vapors are added to the waste gas stream. For example, the flow rate of the vent gas stream can be calculated based on the individual flow rates of the waste gas and other streams and other variables as known to those skilled in the art.

When alternative gas is discharged through the steam injector assembly into the combustion zone in accordance with step (i), the inventive method can further comprise the step of modulating the flow of the alternative gas through the steam injector assembly into the combustion zone. For example, the flow of alternative gas can be modulated such that the air in the alternative gas does not exceed the amount corresponding to the lean explosive limit as is well-known in the art.

The Inventive Flare Assembly

Figure 2:
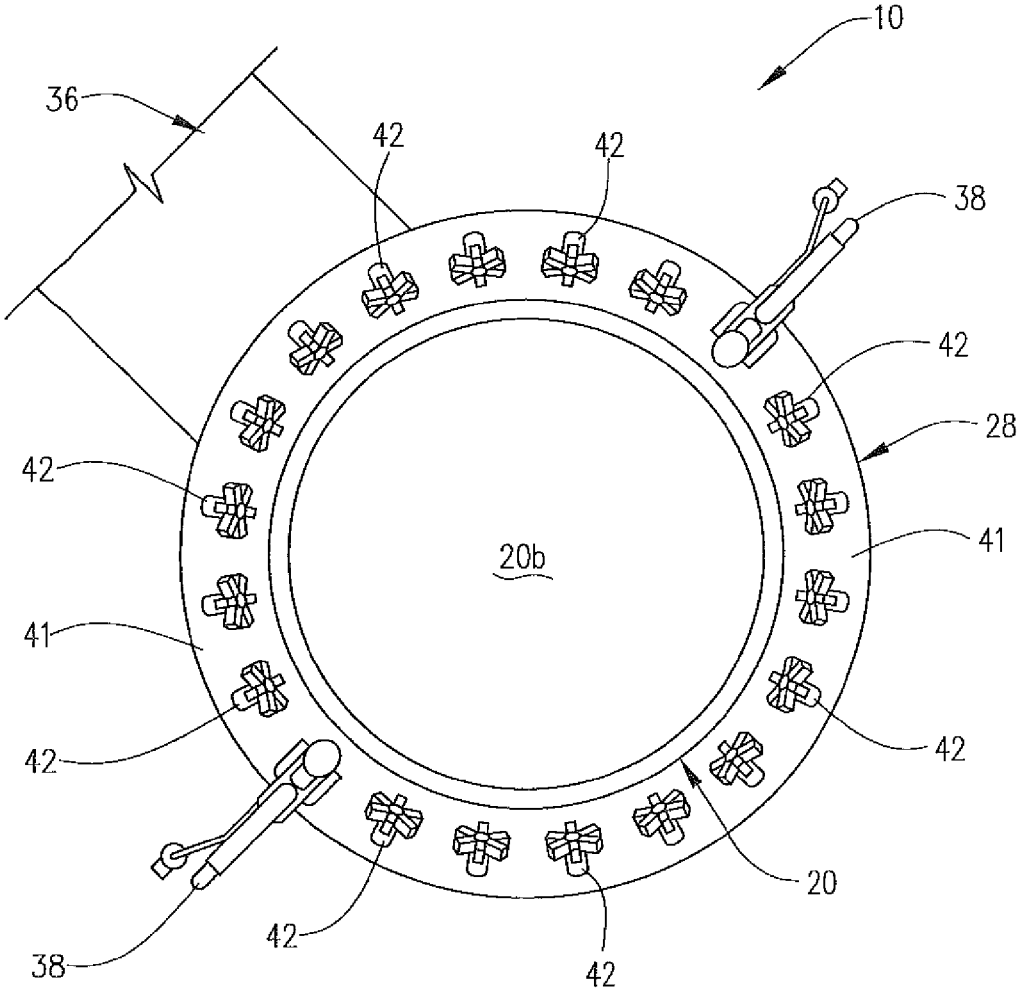
FIG. 2 is a top view of the inventive flare apparatus illustrated by FIG. 1.
Figure 3:
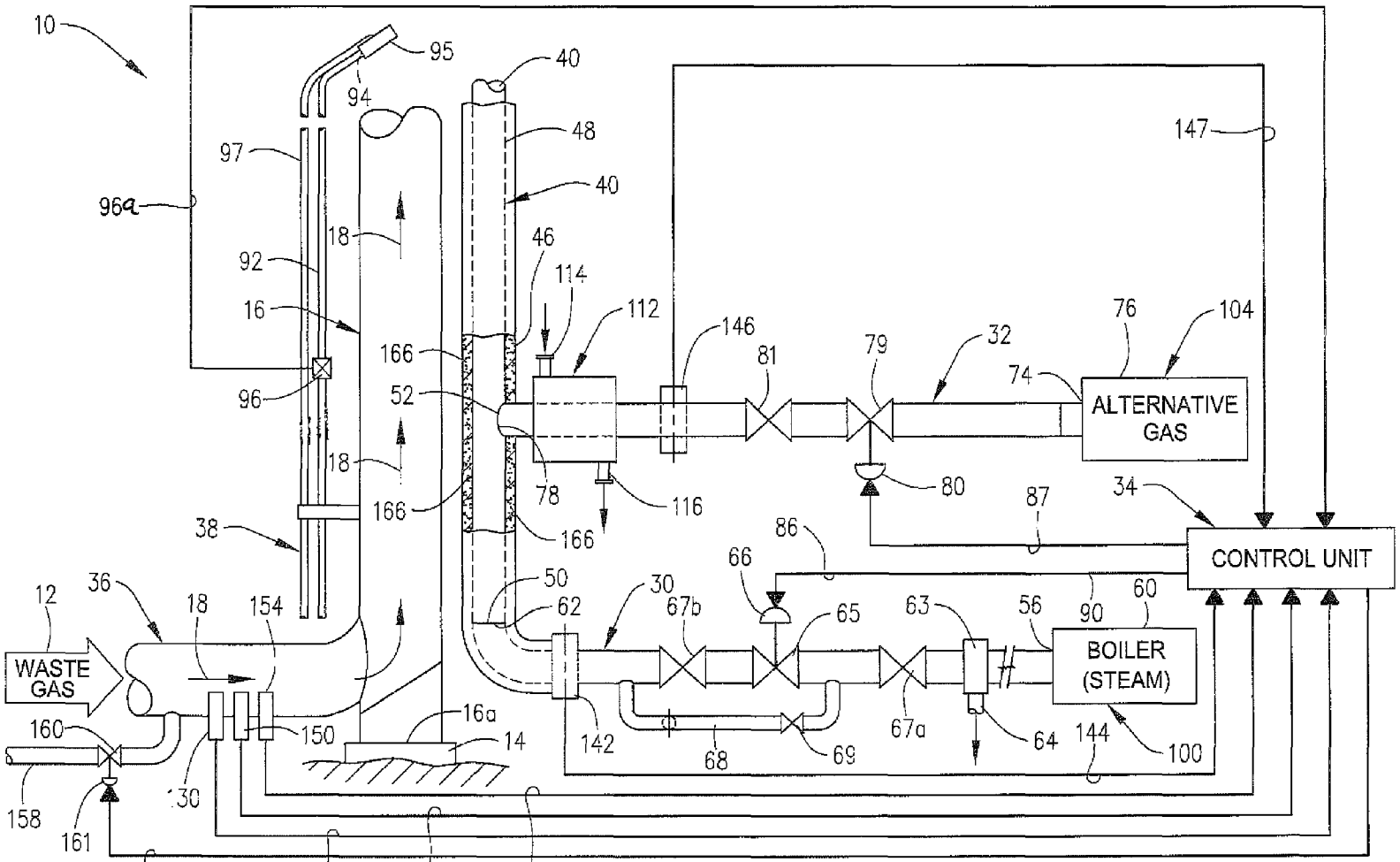
FIG. 3 is a partial schematic view further illustrating the inventive flare apparatus of FIG. 1.

Referring now to FIGS. 1-3, the inventive flare assembly is illustrated and generally designated by the reference number 10. The flare assembly 10 receives a waste gas stream 12 at a varying flow rate.

The flare assembly 10 includes a foundation 14, a flare riser 16 for conducting a vent gas stream 18, a flare tip 20 attached to the flare riser for discharging the vent gas stream into a combustion zone 22 in the atmosphere 24 and burning flare gas in the combustion zone, a steam injector assembly 28 associated with the flare tip, a steam transfer conduit 30, an alternative gas transfer conduit 32, and a control unit 34. A waste gas transfer conduit 36 transfers the waste gas stream 12 released from the facility to the flare riser 16. A pilot assembly 38 is attached to the flare riser 16 and flare tip 20.

The flare riser includes a lower end 16(*a*) attached to the foundation 14 and an upper end 16(*b*). The flare tip 20 includes a lower end 20(*a*) attached to the upper end 16(*b*) of the flare riser and an upper discharge end 20(*b*).

The steam injector assembly 28 includes a steam riser 40 fluidly connected to a steam manifold 41. A plurality of steam injector nozzles 42 are fluidly connected to the steam manifold 41 for injecting primary steam into the combustion zone 22.

The steam injector nozzles 42 direct jets of steam into the combustion zone adjacent the flare tip 20 to aspirate air from the surrounding atmosphere and inject it into the discharged vent gas with high levels of turbulence. The jets of steam from the steam injector nozzles 42 may also act to gather, contain, and guide the gases exiting the flare tip. This prevents wind from causing flame pull down around the flare tip. The injected steam, aspirated air and the vent gas combine to form a mixture that helps the vent gas burn without visible smoke.

The steam riser 40 has a lower section 46 and an upper section 48. The lower section 46 of the steam riser 40 includes a first fluid inlet 50 and a second fluid inlet 52. Each steam injector nozzle 42 is fluidly connected to the upper section 48 of the steam riser 40. Specifically, as shown, the steam injector nozzles 42 are fluidly connected to the steam manifold 41 which is fluidly connected to the steam riser 40.

The steam transfer conduit 30 is fluidly connected at one end 56 to a source of steam 60 and at the other end 62 to the first fluid inlet 50 of the steam riser 40. A condensation trap 63 and condensed water outlet pipe 64 are disposed in the steam transfer conduit 30 to separate any condensation that may accumulate in the steam line running from the source of steam 60. The steam transfer conduit 30 is also fluidly connected to a steam control valve 65 (and associated operating control 66) which operates to control (modulate and/or turn on-off) the flow of the primary steam stream 70 through the steam riser 40. As shown by FIG. 3, the steam control valve 65 (and associated operating control 66) is disposed in the steam transfer conduit 30 and controls (modulates and/or turns on-off) the flow of steam through the steam transfer conduit into the first fluid inlet 50 of the steam riser 40. Manual steam control valves 67(*a*) and 67(*b*) are also disposed in the steam transfer conduit 30 for allowing the flow of primary steam through the steam transfer conduit to be manually shut off (to allow, for example, the steam control valve 65 to be replaced). A bypass conduit 68 is provided to allow some steam to bypass the steam control valves 65 and 67(*b*). The bypass conduit 68 includes a bypass shut-off valve 69 disposed therein which allows the flow of steam through the bypass conduit to be shut off if necessary.

The alternative gas transfer conduit 32 is fluidly connected at one end 74 to a source of alternative gas 76 and at the other end 78 to the second fluid inlet 52 of the lower section 46 of the steam riser 40. The alternative gas transfer conduit 32 is also fluidly connected to an alternative gas control valve 79 (and associated operating control 80) which operates to control (modulate and/or turn on-off) the flow of the alternative gas stream 84 through the steam riser 40. As shown by FIG. 3, the alternative gas control valve 79 (and associated operating control 80) is disposed in the alternative gas transfer conduit 32 and controls (modulates and/or turns on-off) the flow of alternative gas through the alternative gas transfer conduit into the second fluid inlet 52 of the lower section 46 of the steam riser 40. A manual alternative gas control valve 81 is also disposed in the steam transfer conduit 30 for allowing the flow of alternative gas through the alternative gas transfer conduit to be shut off (to allow, for example, the alternative gas control valve 79 to be replaced).

As shown by FIG. 3, the steam control valve 65 (and associated operating control 66), and the alternative gas control valve 79 (and associated operating control 80), are independent of one another and disposed in the steam transfer conduit 30 and alternative gas transfer conduit 32, respectively. As discussed below in connection with FIG. 10, the on-off function of the steam control valve 65 (and associated operating control 66) and alternative gas control valve 79 (and associated operating control 80) can be combined together as a three-way valve and disposed in the steam riser. The three-way valve 200 effectively includes the steam control valve 65, the alternative gas control valve 79 and at least one associated operating control.

The control unit 34 controls the steam control valve 65 (and associated operating control 66) and the alternative gas control valve 79 (and associated operating control 80). As illustrated by FIG. 3, the control unit 34 communicates with the operating control 66 of the steam control valve 65 by way of communication line 86. The control unit 34 communicates with the operating control 80 of the alternative gas control valve 79 by way of communication line 87. The steam control valve 65 and alternative gas control valve 79 are remotely controlled. For example, as described below, the inventive flare assembly can include sophisticated control equipment and functionality. In such a system, the steam control valve 65 is automatically modulated to control the amount of primary steam being discharged through the steam injector assembly to achieve smokeless operation without providing too much steam to the system. Similarly, the alternative gas control valve 79 is automatically modulated to control the amount of alternative gas being discharged through the steam injector assembly. The steam control valve system (including valves 65, 67(*a*) and 67(*b*)), and the alternative gas valve system (including valves 79 and 81) operate in opposition to each other such that when the flow of primary steam is on, the flow of alternative gas is off, and vice versa.

The control unit 34 can consist of or include one or more calculators, computers (and associated hardware and software) and/or other apparatus necessary to control the specific inventive flare assembly in question. For example, the control unit 34 can be in the form of a programmable logic control ("PLC"), or a device with logic embedded in Human Machine Interface ("HMI") script or embedded in a dedicated controller unit.

The pilot assembly 38 includes a pilot fuel gas transfer line 92 connected at one end 93 to a source of pilot fuel gas (not shown) and at the other end 94 to a pilot burner 95. A pilot fuel gas flow sensor 96 is disposed in the pilot fuel gas transfer line 92. A communication line 96(*a*) runs from the flow sensor 96 to the control unit 34. The flow rate of the pilot fuel gas can be used, for example, to account for the heat content of the pilot fuel fed to the pilot burner 95 to enable the Net Heating Value of Flare Gas (NHVFG) calculation (discussed further below). A pilot igniter line 97 is attached at one end 98 to an ignition source (not shown) and at the other end 99 to the pilot burner 95. The pilot burner 95 is positioned in the combustion zone 22 adjacent to the discharge end 20(*b*) of the flare tip 20.

The source of primary steam is a boiler 100. The boiler 100 discharges the primary steam stream 70 at a sufficiently high pressure to force the primary steam stream through the steam transfer conduit 30 into the steam riser 40, through the steam riser 40 into the steam manifold 41 and through the steam injector nozzles 42 into the combustion zone 22.

The alternative gas is air. The air may be mixed with supplemental steam and/or any other gas(es) used as a motive fluid to educt air into the steam injector assembly if an eductor is used.

The source of the air (and hence the source of the alternative gas 76) is the atmosphere surrounding the flare assembly 10. The air is forced through the alternative gas transfer conduit 32 into the steam riser 40, through the steam riser 40 into the steam manifold 41 and through the steam injector nozzles 42 into the combustion zone 22 by an alternative gas mover 104. For example, the alternative gas mover 104 can be a fan or blower having a variable frequency drive, a compressor, an eductor or a corona-discharge electrostatic air mover.

If the alternative gas mover 104 is an eductor, steam can be used as the motive fluid. Steam used as a motive fluid in connection with the eductor, referred to herein as supplemental steam, can come from the same source that provides the primary steam, the steam source 60 which is the boiler 100.

Depending on the application, the inventive flare assembly can also include one or more additional components.

The inventive flare assembly 10 can further comprise a heating assembly 112 attached to one of the alternative gas transfer conduit 32 and the steam riser 40 for heating the alternative gas stream 84 that passes through the steam riser. As shown by FIG. 3, the heating assembly 112 is attached to the alternative gas transfer conduit 32. As discussed above in association with the inventive method, the heating assembly 112 is particularly useful when the flare assembly 10 is operated in freezing conditions. By discharging alternative gas through the steam injector assembly 28 into the combustion zone in lieu of primary steam, the problems associated with the freezing conditions can be avoided. Preheating the alternative gas stream 84 prevents issues with a water hammer condition in connection with the steam riser 40, steam injector assembly 28 and associated equipment and avoids problematic condensation of moisture in the alternative gas.

As illustrated, the heating assembly 112 is a steam powered shell and tube heat exchanger. Steam from a source of steam (which can be the source of steam 60, namely the boiler 100) is fed into the heating assembly 112 through an inlet 114 therein and exits the heat exchanger through an outlet 116 therein. The condensate and spent steam can be recycled to the source of steam from which it was obtained, or disposed of according to applicable regulations. Alternatively, the heating assembly 112 can be an electric heater or a gas fired heater.

The inventive flare apparatus 10 can also include additional components and equipment that allow the flare apparatus to be operated with a higher level of control. For example, the control unit 34 can be expanded to include additional equipment and functionality to facilitate the higher level of control. The additional equipment and functionality of the flare apparatus 10 allow the flare apparatus to respond to more stringent and evolving applicable regulations.

A flow sensor 130 is associated with the flare riser 16 for sensing the flow rate of the vent gas stream 18. Specifically, the flow sensor 130 is disposed in the waste gas transfer conduit 36 at a point therein downstream of points in the waste gas transfer conduit where other gases or vapors such as enrichment fuel gas and purge gas are added to the waste gas stream 12. For example, the flow sensor 130 can be a GE Panametrics Flare Gas Meter Model GF868.

The control unit 34 is capable of calculating a maximum allowable flow rate of primary steam through the steam injector assembly 28 into the combustion zone 22 and modulating the flow rate of primary steam through the steam injector assembly into the combustion zone to avoid a flow rate of steam in excess of the maximum allowable flow rate of steam. The control unit 34 is responsive to the flow rate of the vent gas stream 18. A communication line 134 runs from the control unit 34 to the flow sensor 130. The control unit modulates the flow rate of primary steam through the steam injector assembly 28 by controlling the steam control valve 65 in the steam transfer conduit 30 (via the communication line 86 running from the control unit 34 to the operating control 66 of the control valve 65).

A flow sensor 142 for sensing the flow rate of the primary steam stream 70 discharged through the steam injector assembly 28 is associated with the steam riser 40. The flow sensor 142 is positioned in the steam transfer conduit 30 at a point therein downstream of the steam control valves 65, 67(*a*) and 67(*b*), and communicates with the control unit 34 by way of a communication line 144. For example, a vent gas flow rate signal and a primary steam flow rate signal are continuously sent by the flow sensor 130 and flow sensor 142 to the control unit 34 (via the communication lines 134 and 144) which enables the control unit to continuously calculate the steam/vent gas ratio and maximum allowable flow rate of primary steam through the steam injector assembly into the combustion zone and modulate the flow rate of primary steam accordingly. For example, the flow sensor 142 can be an orifice flow meter (including an orifice plate, differential pressure sensor and transmitter, and fluid temperature sensor and transmitter). As another example, the flow sensor 142 can be a pressure tap and gauge. The primary stream flow rate can be estimated based on the pressure and the hydraulic configuration of the steam transfer duct system and injector assembly (including the length and diameter of the steam riser 40 and total exit area of the steam injector nozzles).

A flow sensor 146 for sensing the flow rate of the alternative gas stream 84 discharged through the steam injector assembly 28 is associated with the steam riser 40. The flow sensor 146 is positioned in the alternative gas transfer conduit 32 at a point therein downstream or upstream of the alternative gas control valves 79 and 81, and communicates with the control unit 34 by way of a communication line 147. For example, the flow sensor 146 can be an orifice flow meter, a Pitot tube flow sensor, an anemometer or a turbine meter. As another example, the flow sensor 146 can be a pressure tap and gauge. The alternative gas stream flow rate can be estimated based on the pressure and the hydraulic configuration of the steam transfer duct system and injector assembly (including the length and diameter of the steam riser 40 and total exit area of the steam injector nozzles).

A molecular weight sensing device 150 for determining the molecular weight of the vent gas stream 18 is associated with the flare riser 16. Specifically, the device 150 is disposed in the waste gas transfer conduit 36 at a point therein downstream of points in the waste gas transfer conduit where other gases or vapors such as enrichment fuel gas and purge gas are added to the waste gas stream 12. The control unit 34 is responsive to the molecular weight of the vent gas stream 18. A communication line 152 runs from the control unit 34 to the molecular weight sensing device 150.

A net heating value sensing device 154 for determining the net heating value of the vent gas stream 18 is associated with the flare riser 16. Specifically, the net heating value sensing device 154 is disposed in the waste gas transfer conduit 36 at a point therein downstream of points in the waste gas transfer conduit where other gases or vapors such as enrichment fuel gas and purge gas are added to the waste gas stream 12. The control unit 34 is responsive to the net heating value of the vent gas stream 18. A communication line 155 runs from the control unit 34 to the device 154.

The control unit 34 calculates the maximum allowable flow rate of primary steam stream 70 through the steam injector assembly 28 into the combustion zone 22 based on various criteria, including applicable regulations with respect to operation of the flare assembly in the location in which the flare assembly is installed, and algorithms established by flare vendors, flare owners and/or flare operators.

Algorithms established by flare vendors, owners and operators are typically more stringent than those necessary to assure that the flare assembly complies with applicable regulations due to the consequence of non-compliance. For example, while regulations may establish an upper limit for flare operation, the most economic and efficient operation of a steam-assisted flare may use less steam than the maximum allowed by regulations, as long as the rate of steam is sufficient to achieve smokeless operation.

Depending on the specific algorithm(s) employed, the maximum allowable flow rate of primary steam through the steam injector assembly into the combustion zone can be calculated by the control unit based on a variety of parameters, including one or more of the following, each of which is determined in accordance with the inventive method:

1. The flow rate of the vent gas stream 18.
2. The maximum steam/vent gas ratio that is to be allowed. The maximum allowable steam/vent gas ratio can be determined based on applicable regulations with respect to operation of the flare assembly in the location in which the flare assembly is installed.
3. The maximum steam/hydrocarbon ratio that is to be allowed. In order to determine the maximum steam/hydrocarbon ratio, the hydrocarbon flow rate must first be determined. The maximum allowable steam/hydrocarbon ratio can be determined based on applicable regulations with respect to operation of the flare assembly in the location in which the flare assembly is installed.
4. The minimum allowable net heating value of the flare gas. The minimum allowable net heating value of the flare gas can be determined based on applicable regulations with respect to operation of the flare assembly in the location in which the flare assembly is installed.
5. The molecular weight of the vent gas stream 18. The molecular weight of the vent gas stream can be determined by, for example, a molecular weight sensor that is disposed in the waste gas transfer conduit or flare riser (as described below) at a point therein downstream of points in the waste gas transfer conduit or flare riser where other gases and vapors, if any, have been added to the waste gas stream but upstream of the flare tip (i.e., at a point in the flare assembly before the vent gas stream enters the flare tip).
6. The net heating value of the vent gas stream 18. The net heating value of the vent gas stream can be determined by, for example, a net heating value sensor that is disposed in the waste gas transfer conduit or flare riser (as described below) at a point therein downstream of points in the waste gas transfer conduit or flare riser where other gases and vapors, if any, have been added to the waste gas stream but upstream of the flare tip (i.e., at a point in the flare assembly before the vent gas stream enters the flare tip).
7. The composition of the vent gas stream. For example, the speciation data from a gas chromatographic device (a "GC Device") can be used to estimate the amount of steam required to achieve smokeless operation and the maximum allowable steam rate in an attempt to achieve high destructive removal efficiency (DRE).
8. Other real time properties of the vent gas stream including but not limited to the associated thermal conductivity and Wobbe Index.

An enrichment fuel gas/purge gas transfer conduit 158 is associated with the flare riser 16 for adding enrichment fuel gas and/or purge gas to the waste gas stream 12. Specifically, the enrichment fuel gas/purge gas transfer conduit 158 is disposed in the waste gas transfer conduit 36 at a point therein upstream of the flow sensor 130, molecular weight sensing device 150 and net heating value sensing device 154. A fuel gas valve 160 (and associated operating control 161) is disposed in the enrichment fuel gas/purge gas transfer conduit 158. The fuel gas valve 160 is controlled by the control unit 34 via a communication line 162 running from the control unit 34 to the operating control 161 for the fuel gas control valve.

The steam riser 40 is insulated with a layer of insulation 166 which helps keep the steam riser warm, maintain the temperature of the primary steam stream 70 or alternative gas stream 84 and prevent condensation. The layer of insulation 166 is wrapped around the steam riser 40.

Figure 4:
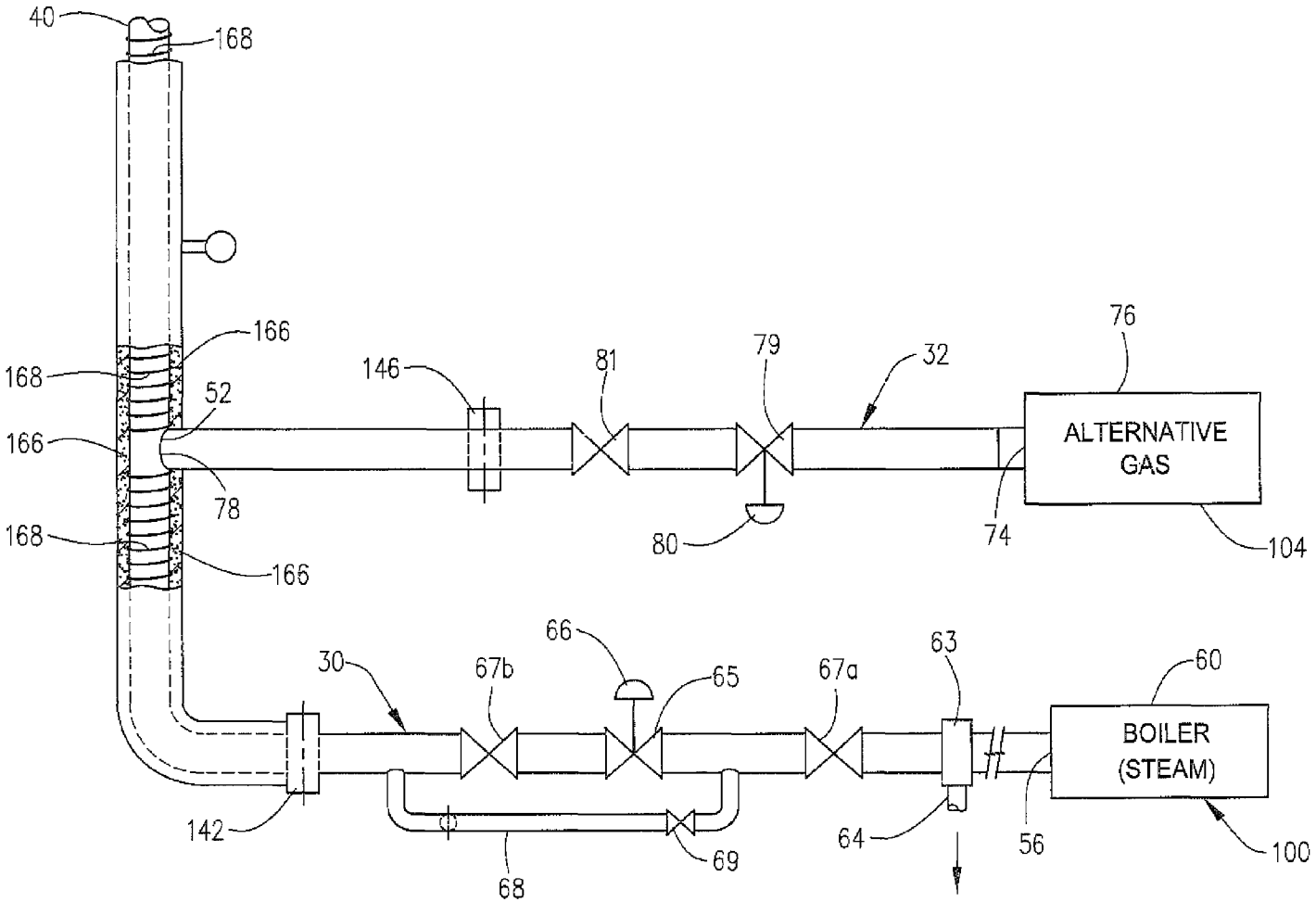
FIG. 4 is a partial schematic view illustrating another configuration of the inventive flare apparatus.

As shown by FIG. 4, a heating element or heat trace 168 is also attached to the steam riser 40 to provide heat thereto. For example, the heating element 168 can a small tube wrapped around the steam riser 40 through which steam is circulated. The steam can be provided from the steam source 60 if desired. As another example, the heating element 168 can be electrical wire that is wrapped around the steam riser 40 and connected to an electrical power source (not shown) to provide resistance heating to the steam riser 40. The layer of insulation 166 can be placed on top of the heating element 168.

Figure 5:
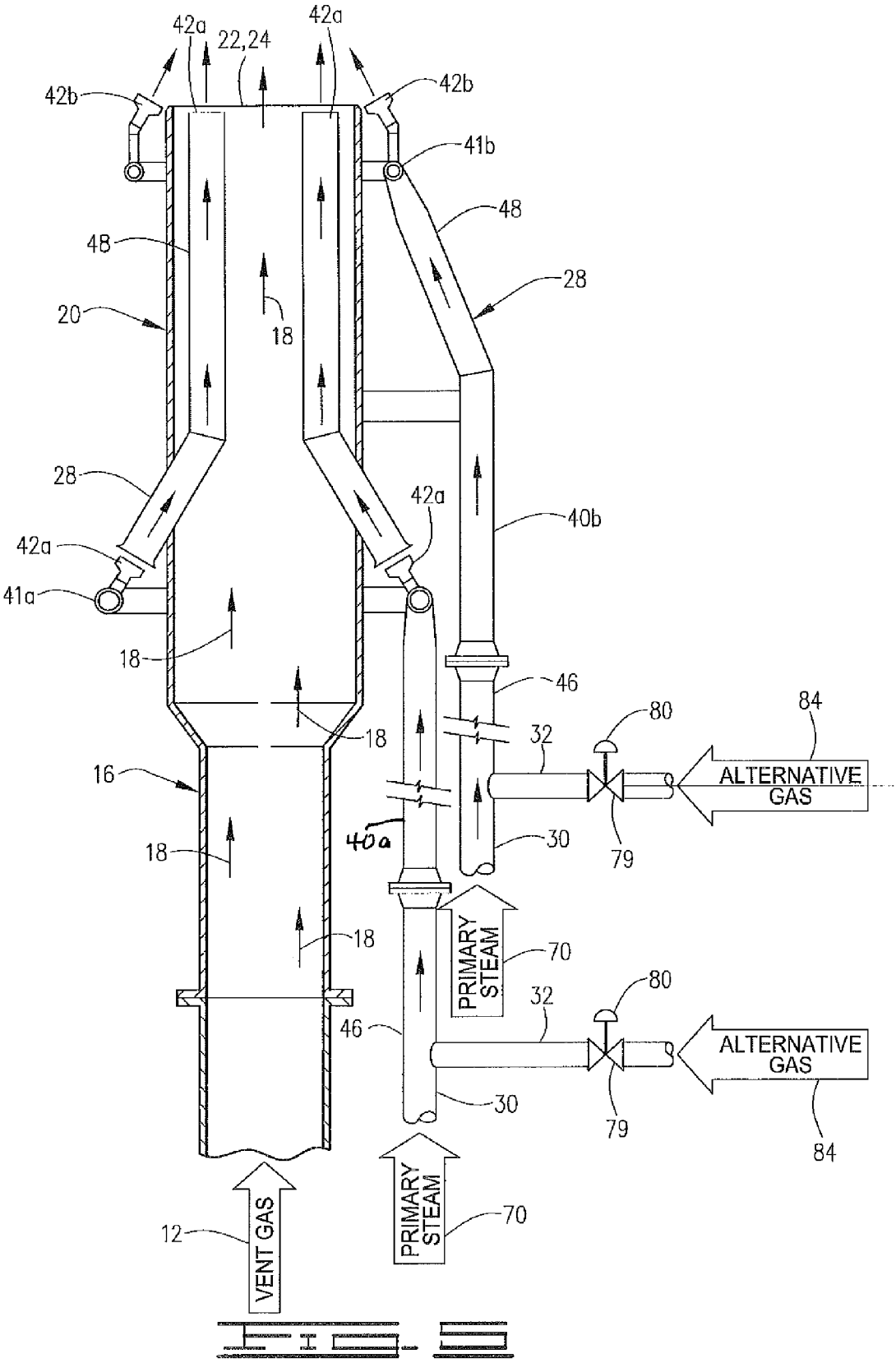
FIG. 5 illustrates another embodiment of the steam injection assembly of inventive flare apparatus.

FIG. 5 shows another configuration of the steam injector assembly 28 that can be used in connection with the inventive flare assembly. In this configuration, two steam risers, 40(*a*) and 40(*b*), are used to supply primary steam and alternative gas to two different steam manifolds 41(*a*) and 41(*b*) and sets of steam injector nozzles 42(*a*) and 42(*b*). The set of steam injector nozzles 42(*a*) are disposed within of the flare tip 20 whereas the set of injector nozzles 42(*b*) are disposed outside the flare tip. A steam transfer conduit 30 and associated steam control valve (not shown) and alternative gas transfer conduit 32 and associated alternative gas control valve 79 are associated with each of the steam risers 40(*a*) and 40(*b*). This is just another example of how the inventive flare assembly can be configured and how the inventive method can be used in association with different configurations of flare assemblies.

Figure 6:
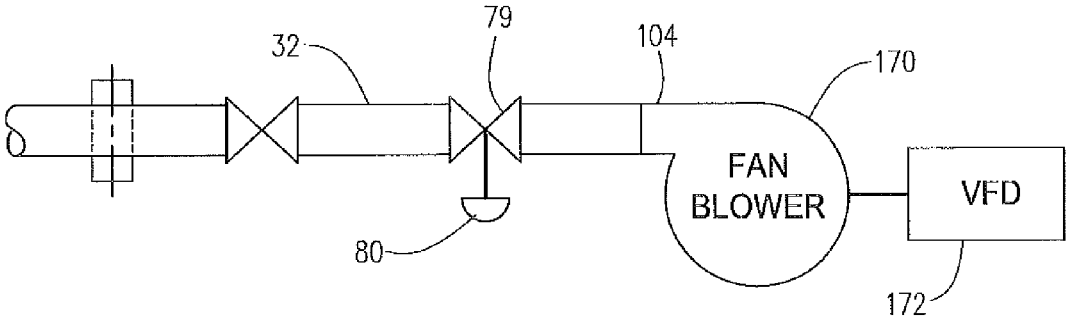
FIG. 6 illustrates the use of a blower with a variable frequency drive as the alternative gas mover of the inventive flare assembly.

FIG. 6 shows the use of a blower 170 with a variable frequency drive 172 as the alternative gas mover 104 of the inventive flare assembly 10. The blower 170 draws air from the atmosphere surrounding the flare assembly and forces it through the alternative gas transfer conduit 32, into the steam riser 40 and through the steam injector assembly 28 into the combustion zone 22.

Figure 7:
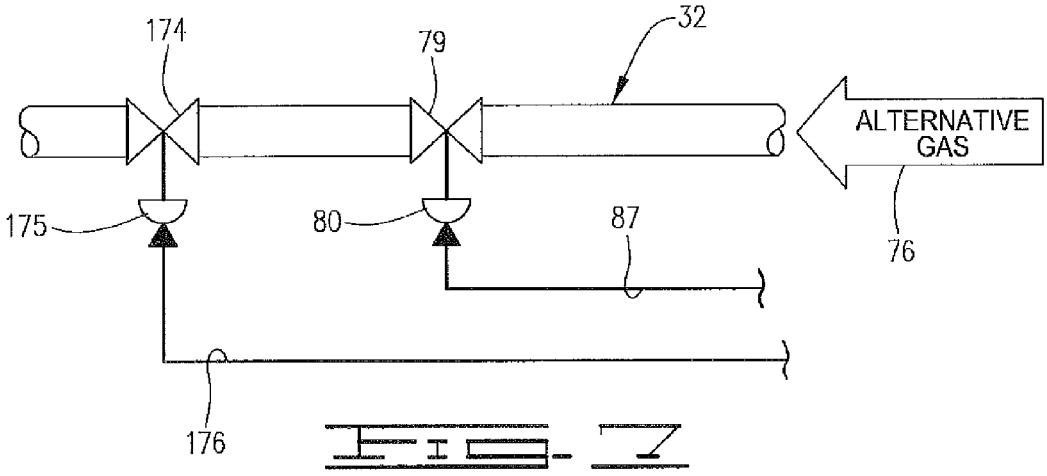
FIG. 7 illustrates another configuration of the alternative gas transfer conduit and valve system.

FIG. 7 shows the use of a second automatic alternative gas control valve 174 (and associated operating control 175) disposed in the alternative gas transfer conduit 32. The alternative gas control valve 174 operates in conjunction with the alternative gas control valve 79 to control the flow of alternative gas through the alternative gas transfer conduit into the second fluid inlet 52 of the steam riser 40. The control unit 34 controls the alternative gas control valve 174 (by way of the associated operating control 175) via a communication line 176. The alternative gas control valve 174 is also remotely controlled. Having two alternative gas control valves in the alternative gas transfer conduit 32 provides for additional control. For example, the alternative gas control valve 79 can be used to modulate the flow of alternative gas through the alternative gas conduit 32 whereas the second alternative gas control valve 174 can be used to turn on and turn off the flow of alternative gas through the alternative gas conduit 32.

Figure 8:
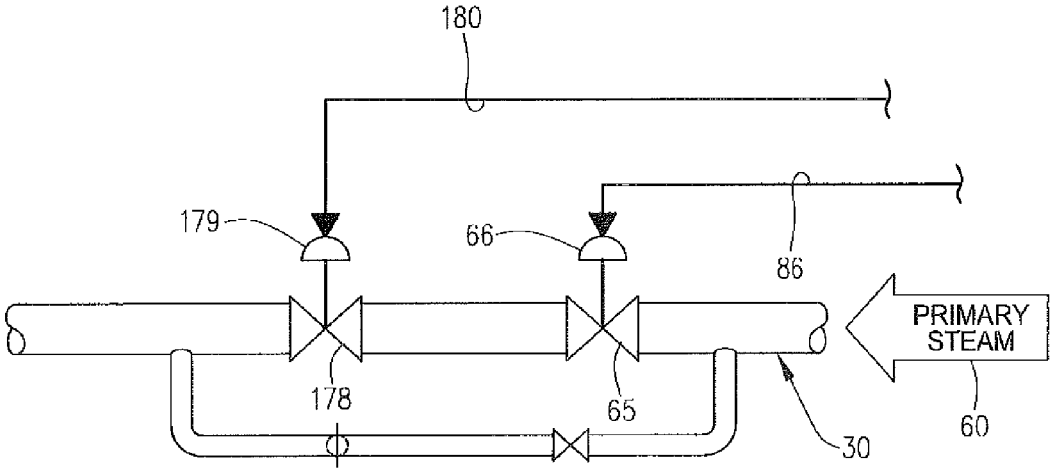
FIG. 8 illustrates another configuration of the steam transfer conduit and associated steam control valves of the inventive flare apparatus.
Figure 3:
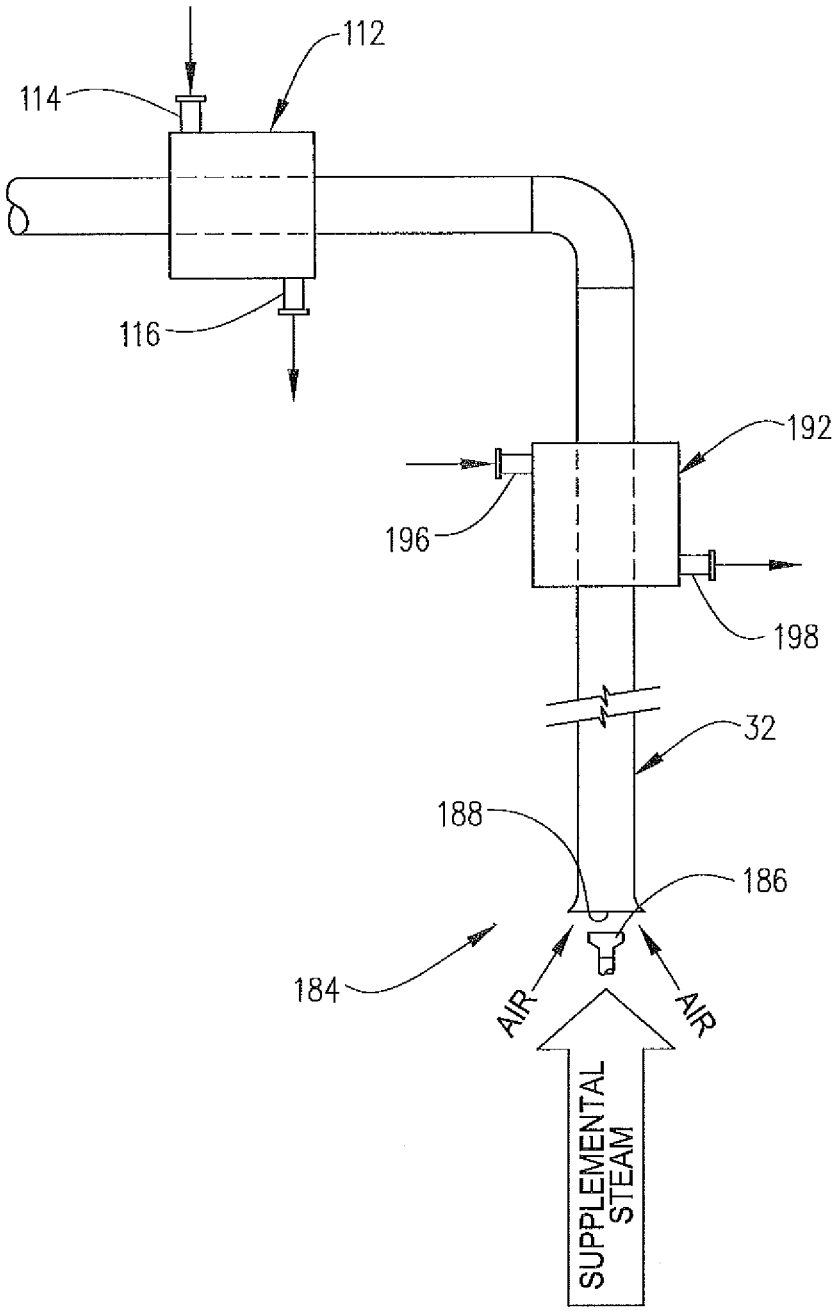

FIG. 8 shows the use of a second automatic steam control valve 178 (and associated operating control 179) disposed in the steam transfer conduit 30. The steam control valve 178 operates in conjunction with the steam control valve 65 to control the flow of steam through the steam transfer conduit 30 into the second fluid inlet 52 of the steam riser 40. The control unit 34 controls the steam control valve 178 (by way of the associated operating control 179) via a communication line 180. The steam control valve 178 is also remotely controlled. Having two steam control valves in the steam transfer conduit 30 provides for additional control. For example, the steam control valve 65 can be used to modulate the flow of steam through the steam transfer conduit 30 whereas the steam control valve 178 can be used to turn on and turn off the flow of steam through the steam transfer conduit 30.

FIG. 9 shows the use of an eductor 184 as the alternative gas mover 104 of the inventive flare assembly 10. The eductor 184 uses supplemental steam (which can be steam from the steam source 60, namely the boiler 100) as a motive fluid to draw air from the atmosphere surrounding the flare assembly and force it through the alternative gas transfer conduit 32, into the steam riser 40 and through the steam injector assembly 28. The supplemental steam is discharged through a steam discharge nozzle 186 into a venturi inlet 188 of the alternative gas transfer conduit 32. A condensing unit 192 is used to cause moisture from the supplemental steam that enters the alternative gas transfer conduit 32 to condense and separate from the alternative gas stream 84. The condensate drains back through the alternative gas transfer conduit and the venturi inlet 188 by gravity. As shown by FIG. 9, the condensing unit 192 is in the form of a tube and shell heat exchanger. Cooled air or water is circulated through an inlet 196, through the condensing unit 192 and out through an outlet 198. The heating assembly 112 is used to heat the alternative gas stream 84 before the alternative gas steam enters the steam riser 40 as discussed above.

Figure 10:
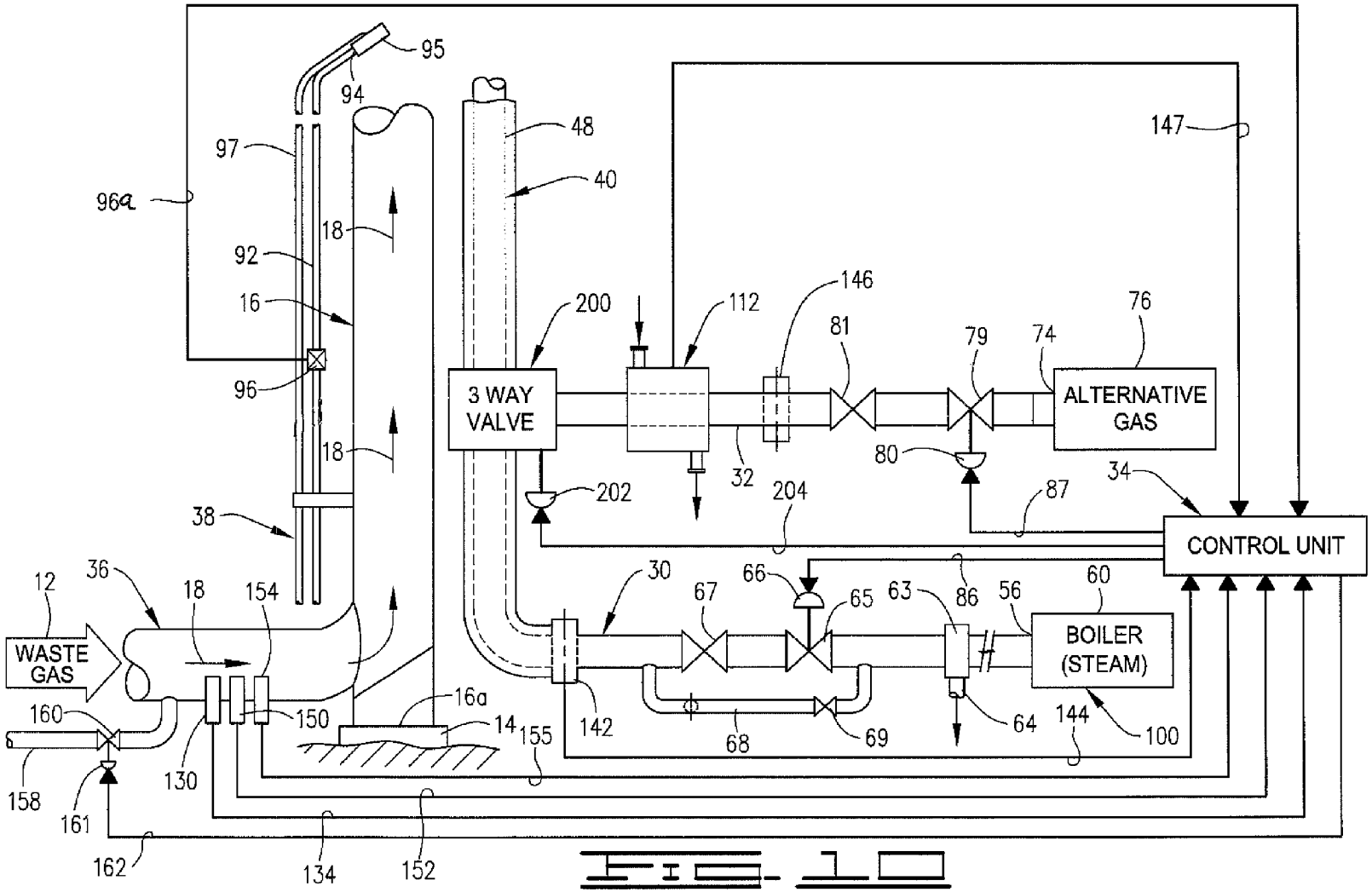
FIG. 10 illustrates the use of a three-way valve in association with the steam transfer and alternative gas conduits of the inventive flare assembly.

As shown by FIG. 10, the steam transfer conduit 30 and alternative gas transfer conduit 32 are fluidly connected to a three-way control valve 200 (and associated operating control 202). Specifically, the three-way control valve 200 is disposed in the steam riser 40 and can be substituted for the on-off functions of the steam control valve 65 (or steam control valve 178 if a second steam control valve is used) and the alternative gas control valve 79 (or alternative gas control valve 174 if a second alternative gas control valve is used). The three-way control valve 200 allows either the flow of primary steam or the flow of alternative gas through the steam injector assembly 28 into the combustion zone 22 in the atmosphere 24. The steam control valve 65 (and operating control 66) in the steam transfer conduit 30 and the alternative gas control valve 79 (and operating control 80) in the alternative gas transfer conduit can still be used to modulate the flow of steam and alternative gas, respectively, into the steam riser 40.

The control unit 34 controls the three-way control valve 200 (and associated operating control 202) by way of a communication line 204. The three-way control valve 200 is remotely controlled and operated such that when the flow of primary steam through the steam riser 40 is on, the flow of alternative gas through the steam riser is off, and vice versa.

Thus, the inventive method and flare assembly provide for primary steam injection with sophisticated control when primary steam injection is necessary to achieve smokeless operation. The sophisticated control allows the inventive flare assembly to be automatically and continuously operated in a manner that achieves smokeless operation, prevents over-steaming and meets new and stringent flare regulations regulating the maximum allowable steam/vent gas ratio, minimum flare gas net heating value and other parameters. The ability to use an alternative gas (air or air mixed with, for example, supplemental steam) in lieu of primary steam when primary steam is not necessary to achieve smokeless operation, when the flare is in standby mode or during a low volume flaring event provides numerous advantages. In many applications, the alternative gas can be used to achieve smokeless operation, cool the parts of the steam injection assembly and keep the steam riser pipe warm (for example, in freezing conditions) during much if not most of the time the flare assembly is operated. The ability to pre-heat the alternative gas allows the inventive flare assembly to be used in freezing conditions, warms the steam riser and related equipment to avoid excessive condensation when the flare is switched from alternative gas mode to primary steam mode and achieves other advantages.

In the United States, the EPA has recently been stepping up efforts to prevent over-steaming. For example, the EPA recently entered into a consent decree with the current and former owners of a certain facility in Ohio (the "Ineos Consent Decree"). The Ineos Consent Decree specifies the following compliance requirement in Paragraph 18(a): "The steam added to the Flare shall not exceed a steam-to-Vent Gas ratio of 3.6 to 1 (3.6:1) lbs of steam/lb Vent Gas sent to the Flare, determined just prior to combustion at the tip of the Flare as a 1-hr Block Average." Thus, this may represent the maximum steam/vent gas ratio allowed by EPA regulations as of today.

Paragraph 18(b) of the Ineos Consent Decree specifies: "The Net Heating Value of Vent Gas shall meet at least 385 Btu/scf as a 1-hour Block Average provided that . . . " Paragraph 19 of the Ineos Consent Decree specified an NHVFG (Net Heating Value of Flare Gas of 200 Btu/scf. Paragraph 24(d) specified an NHVFG to be determined by the Director of Air Enforcement.

In order to calculate the steam/vent gas ratio, the control unit 34 of the inventive flare assembly 10 needs to at least receive input signals based on the vent gas flow rate and primary steam flow rate. As shown by FIGS. 1 and 3, for example, the vent gas flow rate is measured by flow sensor 130, and the primary steam flow rate is measured by steam flow sensor 142. The steam flow rate is modulated by the control unit 34 so that the steam/vent gas ratio is less than the maximum value allowed by EPA regulations.

In a basic form, the control unit 34 can determine the need for primary steam based on the vent gas flow rate alone. For example, the system can operate based on the assumption that when the vent gas mass flow rate is equal to or higher than a certain threshold value, primary steam is required; otherwise, primary steam is not required and the alternative gas is used in lieu thereof as assisting medium. In such a minimal design, the control algorithm for control unit 34 may be:

1) set a normal value for the steam/vent gas ratio, for example $$S=1.2$$

2) estimate the primary steam flow rate required to achieve smokeless operation of the vent gas in accordance with the formula:

$$\dot{m}_s=\dot{m}_{VG}SC \quad (1)$$

Where $\dot{m}_{VG}$ is the vent gas mass flow rate; $\dot{m}_s$ is the steam flow rate required;

S is the steam/vent gas ratio (lbs of steam per lb of vent gas) from the previous step;

and C is a safety factor typically set to 2.0, which is determined by the estimated need for smokeless operation.

3) If the steam flow rate calculated from the previous step is equal to or greater than a certain threshold value, primary steam is required; otherwise alternative gas is used as the assisting medium. Equivalently, this step can be written in terms of a threshold value of the vent gas flow rate, since the primary steam flow rate is simply a constant multiplied by the vent gas flow rate.

4) If primary steam is required, the steam control valve 65 is regulated to achieve the desired primary steam flow rate from step 2), but not to exceed the maximum allowable calculated from the following.

$$\dot{m}_{s,max}=\dot{m}_{VG}SC_{max} \quad (1m)$$

where $\dot{m}_{s,max}$ is the maximum allowable steam flow rate and $C_{max}$ is a factor currently set to 3.0, which is determined according to the most up-to-date EPA regulations.

Note that the maximum value for S*C=1.2*3=3.6 as set by the Ineos Consent Decree. In other words, the maximum steam/vent gas ratio is 3.6. The minimum net heating value of flare gas (NHVFG) of 200 Btu/scf required by the Ineos Consent Decree can be readily met by Equation (1m). For example, natural gas has a NHV of about 930 Btu/scf. Even when pilot gas is omitted, the NHVFG when natural gas is the vent gas is 930/(1+3.6)=202 Btu/scf. When pilot gas is considered, the NHVFG is even higher, thus exceeding the 200 Btu/scf required by the Ineos Consent Decree.

5) If alternative gas is used as the assisting medium, the flow of alternative gas is modulated by the alternative gas control valve 79 to provide enough air to achieve smokeless operation but not too much air such that over-aeration of the flare results.

6) The system keeps looping through all the above steps.

The threshold value of steam in step 3) is determined by designed experiments or field tests. In the field, the threshold value of steam in step 3) can be determined by increasing the vent gas flow rate until even the maximum assisting alternative gas flow rate that can be delivered by the alternative gas mover can no longer achieve smokeless operation. The alternative gas flow can then be shut off and the primary steam flow can be turned on. The flow rate of primary steam can then be reduced until it is slightly more than just enough to achieve smokeless operation. This is the minimum flow that corresponds to the maximum alternative gas flow rate. A powerful alternative gas mover such as a large compressor will cause the threshold value to be relatively large, and primary steam may not be frequently needed. On the other hand, a small air blower will cause the threshold value to be relatively small, and primary steam will be needed more frequently.

The minimal design described above may be adequate when the vent gas stream comprises only hydrocarbon compounds, and does not contain any inert gas or hydrogen. In this case, violations of EPA regulations on minimum net heating value may be avoided by using a maximum steam/vent gas ratio without measuring or calculating the net heating values. As EPA regulations evolve, this minimal design may become inadequate for compliance. For example, such a minimal design of the control unit 34 ignores the differences in gas properties of the vent gas, such as the molecular weight of the vent gas and the tendency of the vent gas to produce smoke.

For more sophisticated control, the primary steam requirement may be further refined based on the molecular weight of the vent gas. Referring to data from Table 10 on page 45 of API Recommended Practice 521 ($4^{th}$ edition) (published in March 1997), and tabulated in Table 1 for reference and plotted in FIG. 11 of this study, a general trend can be seen between the steam requirement and the molecular weight of a gas. Whenever a range is given in API 521, the upper limit is used to ensure that smokeless operation is achieved. For example, a steam requirement of 0.25-0.30 is given in API 521, and 0.30 is used in Table 1. In general, the higher the molecular weight of a gas, the more steam it requires for smokeless operation for a given flow rate of the gas. Such a refinement has its own limitations since the steam requirement for a certain vent gas depends on factors in addition to the molecular weight of the vent gas including the type of gas (paraffin, olefin, diolefin, acetylene, aromatic, etc.), vent gas exit velocity, steam exit velocity, the flare tip design, and whether an inert gas or hydrogen is present in the vent gas stream. However, if 1) the vent gas consists of only hydrocarbon compounds, 2) there is no inert gas in the vent gas stream, and 3) the vent gas contains hydrogen less than 85% by volume, such a refinement based on molecular weight is useful in reducing steam consumption. Minimum net heating values of vent gas and flare gas can be met readily if the algorithm is followed. The hydrogen limit is a result of the lower heating value (LHV) of hydrogen, 290 Btu/scf, which is below the minimum value of 300 Btu/scf for Net Heating Value (NHV) of vent gas as required by 40 C.F.R. §60.18 for steam and air assisted flares. A mixture of 2% methane or any other hydrocarbon compound with 98% hydrogen is sufficient to push the net heating value of the vent gas to above a 300 Btu/scf threshold to meet applicable requirements. A mixture of 15% methane or any other hydrocarbon compound with 85% hydrogen is sufficient to push the net heating value of the vent gas to above 385 Btu/scf as required by the Ineos Consent Decree. A mixture of 15% methane with 85% hydrogen has a molecular weight of about 4.

Figure 11:
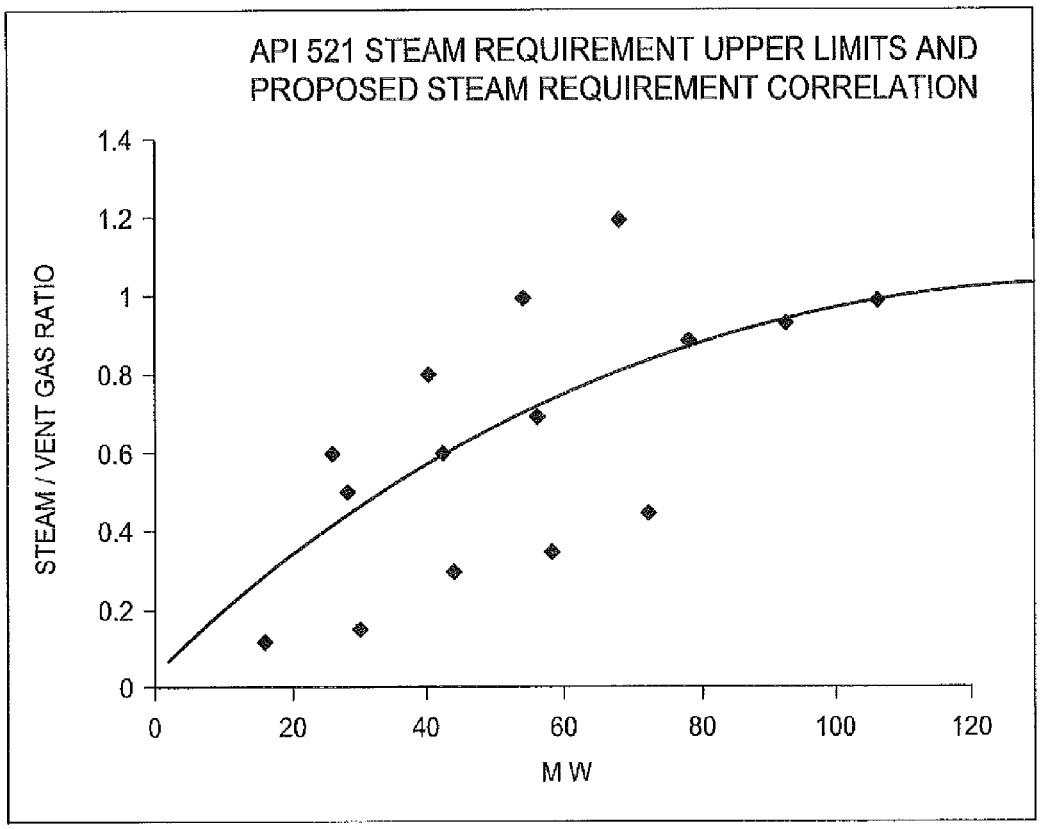
FIG. 11 is a graph that corresponds to the example described in the Detailed Description set forth below and shows upper limits of steam requirements for various hydrocarbon gases per API 521 recommended practice.

A correlation is proposed in this study to estimate the steam requirement using the molecular weight of the vent gas. The correlation is shown as the solid curve in FIG. 11. This curve is analytically expressed by a polynomial as in Equation 2a. Beyond a molecular weight of 106, the curve is extrapolated by a straight line as in Equation 2b. In FIG. 11, the solid curve goes through the points representing the gases with molecular weight less than or equal to 106 and with the medium smoking tendency in Table 1.

In this improved design, the control unit 34 may determine the need for primary steam based on the following algorithm:

1) estimate the primary steam requirement based on the molecular weight of the vent gas stream using Equations 2a and 2b:

$$S=-7.19\times10^{-5}\times MW^2+0.0168\times MW+0.0266 \text{ if } 4<MW<106 \quad (2a)$$

$$S=0.00357\times MW+0.6216 \text{ if } MW>=106 \quad (2b)$$

2) estimate the primary steam flow rate required to achieve smokeless operation of the vent gas using Equation 3.

$$\dot{m}_s=\dot{m}_{VG}SC \quad (3)$$

Where $\dot{m}_{VG}$ is the vent gas mass flow rate; $\dot{m}_s$ is the steam flow rate required;

S is the steam to vent gas ratio (lbs of steam per lb of vent gas) from the previous step;

and C is a safety factor typically set to 2.0, which is determined by the estimated need for smokeless operation.

3) If the primary steam flow rate required in step 2) is equal to or greater than a certain threshold value, primary steam is required; otherwise alternative gas is used as the assisting medium.

4) If primary steam is required, the steam control valve 65 is regulated to achieve the desired primary steam flow rate from step 2), but not to exceed the maximum allowable calculated from the following:

$$\dot{m}_{s,max}=\dot{m}_{VG}SC_{max} \quad (3m)$$

where $\dot{m}_{s,max}$ is the maximum allowable steam flow rate and $C_{max}$ is a factor determined according to the most up-to-date EPA regulations. According to the steam/vent gas ratio limit in the Ineos Consent Decree, $SC_{max}$ should be no more than 3.6, and a further limitation on $C_{max}$ can be applied when the net heating value of the flare gas is calculated according to the formula and procedure outlined in the Ineos Consent Decree.

5) If alternative gas is used as an assisting medium, the flow of the alternative gas is modulated to provide enough air to achieve smokeless operation, but not so much air that over-aeration results.

6) The system keeps looping through all these steps.

In addition to the vent gas flow rate and primary steam flow rate from the flow sensor 130 and the steam flow sensor 142, the control unit 34 also receives a molecular weight signal from the molecular weight device sensor 150. In an alternative embodiment, the vent gas flow rate and the molecular weight of the vent gas are measured by an integral sensor that measures both of these parameters, such as a GE Panametrics Flare Gas Meter Model GF868.

TABLE 1

API 521 Steam Requirement (pound of steam per pound of gas)

| Name | Formula | MW | Steam-to-Vent-Gas-Ratio | Proposed Steam-to-Vent-Gas-Ratio Upper Limit per Correlation |
|---|---|---|---|---|
| Ethane | $C_2H_6$ | 30 | 0.15 | 0.466 |
| Propane | $C_3H_8$ | 44 | 0.3 | 0.627 |
| Butane | $C_4H_{10}$ | 58 | 0.35 | 0.759 |
| Pentane | $C_5H_{12}$ | 72 | 0.45 | 0.863 |
| Ethylene | $C_2H_4$ | 28 | 0.5 | 0.441 |
| Propylene | $C_3H_6$ | 42 | 0.6 | 0.605 |
| Butylene | $C_4H_8$ | 56 | 0.7 | 0.742 |
| Methane* | $CH_4$ | 16 | 0.12 | 0.277 |
| Acetylene | $C_2H_2$ | 26 | 0.6 | 0.415 |
| Propadiene | $C_3H_4$ | 40 | 0.8 | 0.584 |
| Butadiene | $C_4H_6$ | 54 | 1 | 0.724 |
| Pentadiene | $C_5H_8$ | 68 | 1.2 | 0.837 |
| Benzene | $C_6H_6$ | 78 | 0.9 | 0.900 |
| Toluene | $C_7H_8$ | 92 | 0.95 | 0.964 |
| Xylene | $C_8H_{10}$ | 106 | 1 | 1.000 |

*Methane is added by the authors. The proposed correlation for the steam requirement is linearly extrapolated for gases having molecular weights below 26.

FIG. 11 of the drawings illustrates the upper limits of the primary steam requirement data per API 521 as a function of the molecular weight of the vent gas stream and the proposed correlation shown by the solid line.

The control logic algorithm for a generalized scenario, where the vent gas may contain inert gas and hydrogen, is as follows. In order to comply with regulations on minimum heating value such as those in 40 C.F.R. §60.18 and recent EPA regulations, the control unit 34 can take into consideration the vent gas flow rate, vent gas molecular weight and vent gas net heating value. In this generalized form, the control unit 34 receives all of the following input signals: vent gas flow rate from sensor 130, primary steam flow rate from sensor 142, the molecular weight of the vent gas from sensor 150, and the net heating value of the vent gas from the sensor 154.

In this further improved design, the control unit 34 may determine the need for primary steam based on the following algorithm:

1) Compare the net heating value of the vent gas from the sensor 154 to the minimum net heating value of the vent gas required by EPA regulations (including 40 CFR §60.18 and the Ineos Consent Decree, for example). If the measured net heating value of the vent gas is lower than the regulations allow, the fuel gas control valve 160 is opened (if not yet open) and modulated to adjust the enrichment fuel gas injection rate so that the measured net heating value of the vent gas complies with all EPA regulations.

2) Estimate the primary steam requirement based on the molecular weight of the vent gas stream using Equations 4a and 4b.

$$S=-7.19\times10^{-5}\times MW^2+0.0168\times MW+0.0266 \text{ if } MW<106 \quad (4a)$$

$$S=0.00357\times MW+0.6216 \text{ if } MW>=106 \quad (4b)$$

3) Estimate the primary steam flow rate required to achieve smokeless operation.

$$\dot{m}_s=\dot{m}_{VG}SCF \quad (5)$$

Where $\dot{m}_s$ is the primary steam flow rate required; $\dot{m}_{VG}$ is the vent gas mass flow rate;

S is the steam/vent gas ratio estimated from the previous step;

and C is a safety factor typically set to 2.0, which is determined by the estimated need for smokeless operation.

F is a correction factor for the NHV of the vent gas, ranging between 0 and 1.

$$F=\frac{NHVVG_{measured}-NHVFG_{min}}{NHVVG_{ref}-NHVFG_{min}} \text{ if } NHVVG<=NHVVG_{ref} \quad (6)$$

where $NHVVG_{ref}$ is the net heating value of a reference gas, which is a typical hydrocarbon with the same molecular weight as the molecular weight of the vent gas. The net heating value of the reference gas may be estimated using the following equation:

$$NHVVG_{ref}=48MW+151 \text{ (Btu/scf)} \quad (7)$$

NHVVG is the net heating value of vent gas to be flared, and $NHVFG_{min}$ is the minimum net heating value of Flare Gas as required by applicable regulations or other requirements such as good engineering practice adopted by flare vendors and/or flare operators. As of today, $NHVFG_{min}$=200 Btu/scf, but it may change soon in view of the Ineos Consent Decree Paragraph 24(d).

Correction factor F is intended to ensure that the NHV of Flare Gas is always greater than the minimum required. As can be seen from Equation 6, the correction factor approaches zero when the NHVVG approaches the NHVFG.

4) If the primary steam flow rate required is equal to or greater than a certain threshold value, primary steam is required; otherwise alternative gas is used as the assisting medium. This threshold value is determined by designed experiments or field tests. For example, the threshold value can be determined by increasing the vent gas flow rate until even the maximum assisting alternative gas that can be delivered by the alternative gas mover can no longer achieve smokeless operation. Once this occurs, the alternative gas flow is switched off and the primary steam flow is switched on. The primary steam flow rate is then reduced until it is just enough or slightly more than just enough needed to achieve smokeless operation.

5) If primary steam is required, the valve 65 is regulated to achieve the desired primary steam flow rate from step 2), but not to exceed the maximum allowable calculated from the following:

$$\dot{m}_{s,max}=\dot{m}_{VG}SC_{max}F \quad (5m)$$

where $\dot{m}_{s,max}$ is the maximum allowable steam flow rate and $C_{max}$ is a factor determined according to most up-to-date EPA regulations. For example, according to the steam/vent gas ratio limit in the Ineos Consent Decree, $SC_{max}F$ should be no more than 3.6, and further limitation on $C_{max}$ can be applied when the NHVFG is calculated according to the formula and procedure outlined in the Ineos Consent Decree.

6) The system keeps looping through all these previous steps.

If for some reason the above control algorithm is not satisfactory (due to possibly overly stringent regulations), the control algorithm may include other fine tuning mechanisms including, but not limited to: the input of gas chromatographic (GC) data, input based on visual inspection of the flare flame by human eyes and manual adjustment of the safety factor C.

In the calculation of the NHVFG, the heat content of the pilot gas can be fed to the control unit 34. However, in the current invention, steam is used only when vent gas flow is high, and pilot gas flow is very small in comparison. Therefore, the heat content from pilot gas may be omitted for simplicity.

Thus, the present invention is well adapted to carry out the objects and attain the ends and advantages mentioned as well as those which are inherent therein.

What is claimed is:

1. A method of operating a flare assembly that receives a waste gas stream at a varying flow rate, conducts a vent gas stream to a flare tip, discharges the vent gas stream through the flare tip into a combustion zone in the atmosphere, discharges primary steam through a steam injector assembly into the combustion zone and burns flare gas in the combustion zone, comprising:

a. providing a source of alternative gas;
b. providing a source of primary steam;
c. receiving the waste gas stream;
d. determining the flow rate of the vent gas stream;
e. discharging the vent gas stream through the flare tip into the combustion zone;
f. igniting and combusting flare gas in the combustion zone;
g. determining if the injection of primary steam into the combustion zone is necessary to achieve smokeless operation;
h. if it is determined in step (g) that the injection of primary steam into the combustion zone is necessary to achieve smokeless operation, carrying out the following steps:
   i. shutting off the flow of alternative gas through the steam injector assembly into the combustion zone if alternative gas is being discharged through the steam injector assembly into the combustion zone;
   ii. discharging primary steam through the steam injector assembly into the combustion zone;
   iii. determining the flow rate of primary steam discharged through the steam injector assembly into the combustion zone;
   iv. modulating said flow rate of primary steam through the steam injector assembly into the combustion zone to achieve smokeless operation; and
i. if it is determined in step (g) that the injection of primary steam into the combustion zone is not necessary to achieve smokeless operation, carrying out the following steps:
   i. shutting off the flow of primary steam through the steam injector assembly into the combustion zone if primary steam is being discharged through the steam injector assembly into the combustion zone;
   ii. discharging alternative gas through the steam injector assembly into the combustion zone; and
   iii. heating said alternative gas prior to discharging said alternative gas through the steam injector assembly into the combustion zone.

2. The method of claim 1, wherein if it is determined in step (g) that the injection of steam into the combustion zone is necessary to achieve smokeless operation, said method further comprises the step of calculating a maximum allowable flow rate of primary steam through the steam injector assembly into the combustion zone, and said flow rate of primary steam through the steam injector assembly into the combustion zone is modulated in accordance with step (h) (iv) to achieve smokeless operation and avoid a flow rate of steam in excess of said maximum allowable flow rate of steam.

3. The method of claim 2, wherein said maximum allowable flow rate of steam through the steam injector assembly into the combustion zone is calculated based on applicable regulations with respect to operation of the flare assembly in the location in which the flare assembly is installed.

4. The method of claim 3, wherein if it is determined in step (g) that the injection of steam into the combustion zone is necessary to achieve smokeless operation:

the maximum steam/vent gas ratio that is to be allowed is determined; and said maximum allowable flow rate of steam through the steam injector assembly into the combustion zone is calculated based on said vent gas stream flow rate and said maximum steam/vent gas ratio.

5. The method of claim 3, wherein if it is determined in step (g) that the injection of steam into the combustion zone is necessary to achieve smokeless operation:

the hydrocarbon flow rate is determined;

the maximum steam/hydrocarbon ratio that is to be allowed is determined; and said maximum allowable flow rate of steam through the steam injector assembly into the combustion zone is calculated based on said hydrocarbon flow rate and said maximum steam/hydrocarbon ratio.

6. The method of claim 3, wherein if it is determined in step (g) that the injection of steam into the combustion zone is necessary to achieve smokeless operation:

the minimum allowable net heating value of said flare gas is determined; and said maximum allowable flow rate of steam through the steam injector assembly into the combustion zone is calculated based on said vent gas stream flow rate and said minimum allowable net heating value of said flare gas.

7. The method of claim 3, wherein if it is determined in step (g) that the injection of steam into the combustion zone is necessary to achieve smokeless operation:

the molecular weight of the vent gas stream is determined; and said maximum allowable flow rate of steam through the steam injector assembly into the combustion zone is calculated based on said vent gas stream flow rate and said molecular weight.

8. The method of claim 3, wherein if it is determined in step (g) that the injection of steam into the combustion zone is necessary to achieve smokeless operation:

the net heating value of said vent gas stream is determined; and said maximum allowable flow rate of steam through the steam injector assembly into the combustion zone is calculated based on said vent gas stream flow rate and said net heating value of said vent gas.

9. The method of claim 3, wherein if it is determined in step (g) that the injection of steam into the combustion zone is necessary to achieve smokeless operation:

the molecular weight of the vent gas stream is determined;

the net heating value of said vent gas stream is determined; and said maximum allowable flow rate of steam through the steam injector assembly into the combustion zone is calculated based on said vent gas stream flow rate and said molecular weight and net heating value of said vent gas stream.

10. The method of claim 3, wherein said method further comprises the steps of:

determining the actual net heating value of the vent gas stream; and determining the minimum allowable net heating value of the vent gas stream; and if the actual net heating value of the vent gas stream is less than said minimum allowable net heating value of the vent gas stream, adding enrichment fuel gas to the vent gas stream in an amount sufficient to increase said actual net heating value of said vent gas stream to a level that is at least as high as said minimum allowable net heating value of the vent gas stream.

11. The method of claim 1, wherein when alternative gas is selected from the group of air, air mixed with supplemental steam and air mixed with a gas other than supplemental steam that is used as a motive fluid to educt air into the steam injector assembly.

12. A method of operating a flare assembly that receives a waste gas stream at a varying flow rate, conducts a vent gas stream to a flare tip, discharges the vent gas stream through the flare tip into a combustion zone in the atmosphere, discharges primary steam through a steam injector assembly into the combustion zone and burns flare gas in the combustion zone, comprising:

a. providing a source of alternative gas;

b. providing a source of primary steam;

c. receiving the waste gas stream;

d. determining the flow rate of the vent gas stream;

e. discharging the vent gas stream through the flare tip into the combustion zone;

f. igniting and combusting flare gas in the combustion zone;

g. determining if the injection of primary steam into the combustion zone is necessary to achieve smokeless operation;

h. if it is determined in step (g) that the injection of primary steam into the combustion zone is necessary to achieve smokeless operation, carrying out the following steps:

i. shutting off the flow of alternative gas through the steam injector assembly into the combustion zone if alternative gas is being discharged through the steam injector assembly into the combustion zone;

ii. discharging primary steam through the steam injector assembly into the combustion zone;

iii. determining the flow rate of primary steam discharged through the steam injector assembly into the combustion zone;

iv. calculating a maximum allowable flow rate of primary steam through the steam injector assembly into the combustion zone; and v. modulating said flow rate of primary steam through the steam injector assembly into the combustion zone to achieve smokeless operation and avoid a flow rate of steam in excess of said maximum allowable flow rate of steam; and i. if it is determined in step (g) that the injection of primary steam into the combustion zone is not necessary to achieve smokeless operation, carrying out the following steps:

i. shutting off the flow of primary steam through the steam injector assembly into the combustion zone if primary steam is being discharged through the steam injector assembly into the combustion zone; and ii. discharging alternative gas through the steam injector assembly into the combustion zone.

13. The method of claim 12, wherein said maximum allowable flow rate of steam through the steam injector assembly into the combustion zone is determined based on applicable regulations with respect to operation of the flare assembly in the location in which the flare assembly is installed.

14. The method of claim 12, wherein if it is determined in step (g) that the injection of steam into the combustion zone is necessary to achieve smokeless operation:

the maximum steam/vent gas ratio that is to be allowed is determined; and said maximum allowable flow rate of steam through the steam injector assembly into the combustion zone is calculated based on said vent gas stream flow rate and said steam/vent gas ratio.

15. The method of claim 14, wherein said maximum steam/vent gas ratio is determined based on applicable regulations with respect to operation of the flare assembly in the location in which the flare assembly is installed.

16. The method of claim 12, wherein if it is determined in step (g) that the injection of steam into the combustion zone is necessary to achieve smokeless operation:

the hydrocarbon flow rate is determined;

the maximum steam/hydrocarbon ratio that is to be allowed is determined; and said maximum allowable flow rate of steam through the steam injector assembly into the combustion zone is calculated based on said hydrocarbon flow rate and said maximum steam/hydrocarbon ratio.

17. The method of claim 16, wherein said maximum steam/hydrocarbon ratio is determined based on applicable regulations with respect to operation of the flare assembly in the location in which the flare assembly is installed.

18. The method of claim 12, wherein if it is determined in step (g) that the injection of steam into the combustion zone is necessary to achieve said desired effect:

the minimum allowable net heating value of said flare gas is determined; and said maximum allowable flow rate of steam through the steam injector assembly into the combustion zone is calculated based on said flow rate of the vent gas stream and said minimum allowable net heating value of said flare gas.

19. The method of claim 18, wherein if it is determined in step (g) that the injection of steam into the combustion zone is necessary to achieve smokeless operation:

the molecular weight of the vent gas stream is determined;

the net heating value of the vent gas stream is determined; and said maximum allowable flow rate of steam through the steam injector assembly into the combustion zone is calculated based on said flow rate of the vent gas stream, said molecular weight and said net heating value of the vent gas.

20. The method of claim 19, wherein said minimum allowable net heating value of said flare gas is determined based on applicable regulations with respect to operation of the flare assembly in the location in which the flare assembly is installed.

21. The method of claim 12, wherein if it is determined in step (g) that the injection of steam into the combustion zone is necessary to achieve said desired effect:

the molecular weight of the vent gas stream is determined; and said maximum allowable flow rate of steam through the steam injector assembly into the combustion zone is calculated based on said flow rate of the vent gas stream and said molecular weight.

22. The method of claim 12, wherein if it is determined in step (g) that the injection of steam into the combustion zone is necessary to achieve smokeless operation:

the net heating value of said vent gas stream is determined; and said maximum allowable flow rate of steam through the steam injector assembly into the combustion zone is calculated based on said vent gas stream flow rate and said net heating value of said vent gas.

23. The method of claim 12, wherein said method further comprises the steps of:

determining the actual net heating value of the vent gas stream; and determining the minimum allowable net heating value of the vent gas stream; and if the actual net heating value of the vent gas stream is less than said minimum allowable net heating value of the vent gas stream, adding enrichment fuel gas to the vent gas stream in an amount sufficient to increase said actual net heating value of said vent gas stream to a level that is at least as high as said minimum allowable net heating value of the vent gas stream.

24. The method of claim 12, wherein when alternative gas is selected from the group of air, air mixed with supplemental steam and air mixed with a gas other than supplemental steam that is used as a motive fluid to educt air into the steam injector assembly.

* * * * *